US012765705B2

(12) United States Patent
Luttrell et al.

(10) Patent No.: US 12,765,705 B2
(45) Date of Patent: Oct. 20, 2026

(54) CURTAIN ASSEMBLY AND METHOD OF USING SAME

(71) Applicant: Standard Textile Co., Inc., Cincinnati, OH (US)

(72) Inventors: Amy M. Luttrell, Cincinnati, OH (US); Rajib Mondal, Gulf Breeze, FL (US); Joy Hornberger, Batesville, IN (US); Mathew Kluth, Brecksville, OH (US); Sara Arvidson Broadaway, Woodruff, SC (US); Jennifer Sharp, Cincinnati, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 244 days.

(21) Appl. No.: 18/501,747

(22) Filed: Nov. 3, 2023

(65) Prior Publication Data

US 2025/0143501 A1 May 8, 2025

(51) Int. Cl.
*A47H 13/04* (2006.01)
*A47H 1/06* (2006.01)
*A47H 23/08* (2006.01)

(52) U.S. Cl.
CPC ..... *A47H 13/04* (2013.01); *A47H 1/06* (2013.01); *A47H 23/08* (2013.01)

(58) Field of Classification Search
CPC .. A47H 2015/005; A47H 15/02; A47H 15/04; A47H 15/00; A47H 13/00; A47H 13/04; A47H 1/04; A47H 1/18; A47H 2201/02; Y10T 24/51; E06B 9/362
See application file for complete search history.

(56) References Cited

U.S. PATENT DOCUMENTS

| | | | | |
|---|---|---|---|---|
| 684,830 | A | 10/1901 | Lane | |
| 1,041,563 | A | 10/1912 | Andrejkovits | |
| 1,406,685 | A | 2/1922 | Rohr | |
| 2,412,608 | A | 12/1946 | Fridolph | |
| 2,562,029 | A | 7/1951 | Fridolph | |
| 2,670,167 | A * | 2/1954 | Nelson | E06B 9/323 292/300 |
| 2,827,656 | A | 3/1958 | Weber | |
| 2,834,980 | A | 5/1958 | Fridolph | |
| 3,259,298 | A | 7/1966 | Gorton | |
| 3,823,439 | A | 7/1974 | Selset | |

(Continued)

*Primary Examiner* — Daniel P Cahn
*Assistant Examiner* — Jeremy C Ramsey
(74) *Attorney, Agent, or Firm* — Wood Herron & Evans LLP

(57) ABSTRACT

A curtain assembly is provided, including a curtain track that is configured to be secured to a ceiling or a wall. The curtain assembly further includes a curtain suspended from the curtain track. The curtain assembly further includes a plurality of hooks to suspend the curtain from and slidably secure the curtain to the curtain track. The curtain assembly further includes an end cap located adjacent to and surrounding an exterior portion of an end of the curtain track. A portion of the end cap is configured to selectively transition between an open position and a closed position. In the closed position, the portion of the end cap is configured to restrict at least one hook of the plurality of hooks from entering or exiting the curtain track. The curtain assembly is configured to enable curtain replacement without specialized hand tools while also reducing ambient noise during use.

21 Claims, 12 Drawing Sheets

(56) References Cited

U.S. PATENT DOCUMENTS

| | | | | |
|---|---|---|---|---|
| 4,688,620 | A | 8/1987 | Lechner et al. | |
| 5,265,837 | A * | 11/1993 | Marocco | E06B 9/323 160/902 |
| 6,098,699 | A | 8/2000 | Junius | |
| 6,202,341 | B1 | 3/2001 | Bernard | |
| 6,308,387 | B1 | 10/2001 | Borzi | |
| 7,314,334 | B1 | 1/2008 | Bennett et al. | |
| 8,286,304 | B2 | 10/2012 | Valade | |
| 8,479,800 | B2 | 7/2013 | Graneto, III et al. | |
| 9,125,509 | B2 | 9/2015 | Graneto, III | |
| 9,149,144 | B2 | 10/2015 | Graneto, III | |
| 9,456,711 | B2 | 10/2016 | Buxkemper-Odenkirk | |
| 9,585,508 | B2 | 3/2017 | Graneto, III | |
| 9,861,222 | B2 | 1/2018 | Bauer et al. | |
| 10,458,791 | B2 | 10/2019 | Guma et al. | |
| 10,767,685 | B2 | 9/2020 | Bauer et al. | |
| 11,406,213 | B2 | 8/2022 | Goelst | |
| 11,432,672 | B2 | 9/2022 | Olsen et al. | |
| 2005/0223577 | A1 * | 10/2005 | Scarborough | G01C 9/28 248/467 |
| 2006/0289126 | A1 | 12/2006 | Kollman et al. | |
| 2007/0089841 | A1 | 4/2007 | Rossato et al. | |
| 2007/0267153 | A1 | 11/2007 | Hardy | |
| 2009/0114351 | A1 | 5/2009 | Shilts | |
| 2009/0205791 | A1 * | 8/2009 | Sans Folch | A47H 13/04 160/368.1 |
| 2012/0018106 | A1 | 1/2012 | Robledo | |
| 2013/0117927 | A1 | 5/2013 | Woodruff | |
| 2014/0000821 | A1 | 1/2014 | DeWees et al. | |
| 2020/0300288 | A1 | 9/2020 | Bauer et al. | |
| 2022/0007872 | A1 | 1/2022 | Stern | |
| 2022/0015564 | A1 | 1/2022 | Olsen et al. | |
| 2023/0287736 | A1 * | 9/2023 | Freirich | E06B 9/323 |

* cited by examiner

CURTAIN ASSEMBLY AND METHOD OF USING SAME

TECHNICAL FIELD

This application relates generally to a curtain assembly, and, more specifically, to a cubicle curtain assembly for use in a healthcare setting for patient privacy.

BACKGROUND

In a healthcare setting, curtains, such as cubicle curtains, can provide a private enclosure for a patient. A cubicle curtain typically hangs on hooks that are attached to a carrier. The carrier typically slides into and along a ceiling-mounted track. Following initial installation, the end of the track is capped to contain the carriers and subsequent curtain replacements are accomplished by unhooking the curtain from the hooks. Curtains are typically switched out when they become soiled and/or to reduce the spread of pathogens. However, existing cubicle curtains exhibit several drawbacks when it comes to removal and replacement.

For example, removal of a typical cubicle curtain from the hooks can be difficult and/or time consuming. A cubicle curtain typically hangs from a curtain track by a number of hooks. Each hook must be interacted with by hand so that the curtain can be removed. In some cases, a specialized hand tool may be available or a portion of the track and/or track cap may be removeable to aid in removing the curtain from the hooks. However, the specialized hand tool or removeable portion of the track and/or track cap may be easily lost or misplaced—particularly, in a fast-paced healthcare environment. Furthermore, existing track caps or closures are generally multi-piece assemblies that can be subject to misplacement of parts during a curtain change, or may require tools to assure correct installation and retention of curtains during later use. Accordingly, it would be desirable to provide a curtain (and/or curtain assembly) that can be quickly and easily removed from the curtain track without the use of specialized hand tools.

Further, hospitals, and other healthcare environments, tend to be loud, which can hinder patient rest and recuperation. Typical cubicle curtain carriers are plastic and/or metal and are conveyed along a metal track. Thus, movement of the curtain along the track can be noisy and disturb the patient. Accordingly, it would be desirable to provide a curtain (and/or curtain assembly) that significantly reduces the noise generated when conveying a curtain along a track.

Further, as mentioned above, typical cubicle curtain carriers include a hook to attach the curtain to the track. These hooks can inadvertently make their way into a laundry system when reusable curtains are cleaned and ultimately may end up lost or damaged. These hooks can snag, tear, and tangle the curtain during laundering or during installation/removal of curtains. This can particularly be an issue if the curtain includes a mesh portion. Moreover, if not lost, these hooks and/or carriers may become hazards and fall from the curtain track onto a user during installation or removal of the curtain. Accordingly, it would be desirable to provide a curtain (and/or curtain assembly) that prevents or limits damage and tangling of the curtain during installation, removal, and/or laundering. Particularly, it would be desirable to provide a hook that is integral with the curtain such that the hook can be laundered with the curtain.

SUMMARY

Certain exemplary aspects of the invention are set forth below. It should be understood that these aspects are presented merely to provide the reader with a brief summary of certain forms the invention might take and that these aspects are not intended to limit the scope of the invention.

In one aspect of the disclosure, a curtain assembly is provided. The curtain assembly includes a curtain track having a cavity extending along a length of the curtain track. The curtain track is configured to be secured to a ceiling or a wall. The curtain assembly further includes a curtain suspended from the curtain track. The curtain is defined by a first lateral edge, a second lateral edge, a top edge, and a bottom edge. The curtain assembly further includes a plurality of hooks suspending the curtain from the curtain track. At least one hook of the plurality of hooks has a first end and a second end opposite the first end. The first end is operatively connected to the curtain adjacent the top edge of the curtain. The second end is configured to be housed within the cavity of the curtain track to slidably secure the curtain to the curtain track. The curtain assembly further includes a monolithic end cap located adjacent to and surrounding an exterior portion of an end of the curtain track. A portion of the end cap is configured to selectively transition between an open position and a closed position. In the closed position, the portion of the end cap is configured to restrict the at least one hook of the plurality of hooks from entering or exiting the cavity via the end of the curtain track. Advantageously, the monolithic construction of the end cap allows for selective, temporary access for insertion or removal of the hooks to and from the curtain track without requiring use of tools or holding separated parts, which may be particularly challenging in settings where the curtain track is installed along a high ceiling.

In one embodiment, the end cap may include an end cap body having an end wall, a first side wall, and a second side wall. The first side wall and the second side wall may be connected to and extend from the end wall. Further, the end cap body may define an inner periphery configured to face towards the curtain track and an outer periphery configured to face away from the curtain track. The inner periphery of the end cap body may be arranged in a confronting relationship with the exterior of the curtain track. The end cap may further include a flange pivotably connected to the end wall of the end cap body by a living hinge. The flange may be configured to selectively transition between the open position and the closed position. In the closed position, the flange may be configured to restrict the at least one hook of the plurality of hooks from entering or exiting the cavity via the end of the curtain track. Further, the first wall of the end cap body may include a lip portion at an end of the first wall. The second wall of the end cap body may also include a lip portion at an end of the second wall. The flange may include a first catch feature and a second catch feature. The first catch feature and the second catch feature may be located on opposing lateral edges of the flange adjacent a living hinge. In the closed position, the lip portion of the first wall may interface with the first catch feature of the flange and the lip portion of the second wall may interface with the second catch feature of the flange to selectively restrict the at least one hook of the plurality of hooks from entering or exiting the cavity via the end of the curtain track.

In another embodiment, in the closed position the flange may be substantially parallel to the end face of the curtain track. Further, the first side wall of the end cap may overlap the exterior of the curtain track for a majority of a length and a width of the first side wall. And the second side wall of the end cap may overlap the exterior of the curtain track for a majority of a length and a width of the second side wall. Further, the end wall of the end cap body may extend an end wall width between the first wall and the second wall, the flange may extend a flange width between a first lateral edge of the flange and a second lateral edge of the flange, and a width of the living hinge may be substantially coextensive with the end wall width and the flange width.

In a further embodiment, the end cap may be releasably secured to the curtain track by a transition and/or interference fit (e.g., a friction fit) between the end cap and the curtain track. Alternatively, a mechanical fastener may pass through both the curtain track and the end wall of the end cap to releasably secure the end cap to the curtain track. More specifically, the end wall of the end cap may further include an aperture and the mechanical fastener may pass through both the curtain track and the aperture of the end wall of the end cap to releasably secure the end cap to the curtain track.

In yet another embodiment, the at least one hook of the plurality of hooks may include a hook head at the second end of the at least one hook. The hook head may include a top layer and a bottom layer. The top layer and the bottom layer may be secured together to form the hook head. The at least one hook may also include a hook body extending away from the hook head. The hook body may terminate in the first end of the at least one hook.

In one embodiment, the top layer and the bottom layer of the hook head may be secured together to form a substantially Y-shaped hook head. The substantially Y-shaped hook head may be configured to avoid catching on a fastener extending into the cavity of the curtain track. Alternatively, the top layer and the bottom layer of the hook head may be secured together to form a substantially T-shaped hook head. The substantially T-shaped hook head may be configured to avoid catching on a fastener extending into the cavity of the curtain track. The hook head may include a reinforcement layer located between the top layer and the bottom layer of the hook head. The reinforcement layer may be secured to the top layer of the hook head. The reinforcement layer may be configured to add additional rigidity to the hook head. Further, the top layer and the bottom layer of the hook head may be secured together by fastening selected from the group consisting of: stitching, thermal welding, ultrasonic welding, and adhesive.

In another embodiment, the at least one hook of the plurality of hooks may be fixed to the curtain so as not to be readily removeable from the curtain. Further, the at least one hook of the plurality of hooks may be configured to be laundered with the curtain. The curtain may include a first face and a second face. The second face may be located diametrically opposite the first face. The at least one hook of the plurality of hooks may be operatively connected to at least one of the first face of the curtain and the second face of the curtain. Alternatively, the at least one hook of the plurality of hooks may operatively connected to both of the first face of the curtain and the second face of the curtain.

In a further embodiment, the at least one hook of the plurality of hooks may be constructed of a textile material. Further, the at least one hook of the plurality of hooks may be constructed so as to form a single contiguous piece of textile material. Alternatively or additionally, the at least one hook of the plurality of hooks may be constructed of a single continuous piece of textile material. Further, the textile material may be selected from the group consisting of: nylon, polyester, cotton, and polypropylene. The at least one hook of the plurality of hooks may be configured to change a material property when laundered and/or heated such that a pull force required to pull the at least one hook through a curtain track opening increases after the at least one hook is laundered and/or heated. By forming the plurality of hooks with one or more of the features as set forth above, the curtain assembly can operate with a significantly reduced movement volume as compared to conventional designs, thereby increasing patient satisfaction and comfort in this setting. Moreover, the integrated design of the hooks with the curtain allows for quicker and simpler replacement and installation actions with fewer parts to assemble and less likelihood of losing elements of the assembly (while assuring that the correct number of hooks or hangar elements is always connected to a curtain placed at the curtain track).

In one embodiment, the curtain may include curtain fasteners located adjacent the first lateral edge and located adjacent the second lateral edge of the curtain. The curtain fasteners may be configured to selectively secure the curtain to a neighboring curtain. Further, the curtain may include curtain fasteners located adjacent the first lateral edge and located adjacent the second lateral edge of the curtain. Additionally or alternatively, the curtain fasteners located adjacent the first lateral edge may be on the second face of the curtain and the curtain fasteners located adjacent the second lateral edge may be on the first face of the curtain. The curtain fasteners may be configured to selectively secure the curtain to a neighboring curtain.

In another aspect of the disclosure, a curtain assembly is provided. The curtain assembly includes a curtain track having a cavity extending along a length of the curtain track. The curtain track is configured to be secured to a ceiling or a wall. The curtain assembly further includes a curtain suspended from the curtain track. The curtain is defined by a first lateral edge, a second lateral edge, a top edge, and a bottom edge. The curtain assembly further includes a plurality of hooks suspending the curtain from the curtain track. At least one hook of the plurality of hooks having a first end and a second end opposite the first end. The first end is operatively connected to the curtain adjacent the top edge of the curtain. The second end is configured to be housed within the cavity of the curtain track to slidably secure the curtain to the curtain track. The at least one hook is configured to be laundered with the curtain. The curtain assembly further includes an end cap located adjacent to and surrounding an exterior portion of an end of the curtain track. A portion of the end cap is configured to selectively transition between an open position and a closed position. In the closed position, the portion of the end cap is configured to restrict the at least one hook of the plurality of hooks from entering or exiting the cavity via the end of the curtain track.

In another aspect of the disclosure, a method of using a curtain assembly is provided. The method includes providing a curtain assembly including a curtain and a plurality of hooks. The plurality of hooks are operatively connected to the curtain adjacent a top edge of the curtain. The method further includes inserting at least one hook of the plurality of hooks into a cavity of the curtain track. The cavity is configured for receiving the at least one hook of the plurality of hooks. The curtain track further includes a monolithic end cap located adjacent to and surrounding an exterior portion of an end of the curtain track. The method further includes closing the end cap to restrict the at least one hook of the plurality of hooks from exiting the cavity via the end of the curtain track.

In one embodiment, the method may further include opening the end cap to allow the at least one hook of the plurality of hooks to enter or exit the cavity of the curtain track. The method may further include removing the at least one hook of the plurality of hooks from the curtain track. Further, the step of closing the end cap may include mating one or more lip portions of a body of the end cap with one or more catch features of a flange of the end cap.

In another embodiment, the at least one hook of the plurality of hooks may be constructed of a textile material. The method may further include sliding the at least one hook along the curtain track and producing a peak noise of less than 65 dB. Further, the method may further include laundering the curtain assembly with the plurality of hooks operatively connected to the curtain. The method may further include laundering and/or heating the at least one hook of the plurality of hooks. Laundering the at least one hook may change a material property of the at least one hook and may increase a pull force required to pull the at least one hook through a curtain track opening. For example, the pull force required to pull the laundered at least one hook through a curtain track opening may be greater than 40 lbs. The integrated nature of the hooks and the curtain helps prevent any hazards of hangar hardware falling from the track onto users or patients during installation or replacement of a curtain.

In a further embodiment, the at least one hook of the plurality of hooks may be pulled through the curtain track opening by a pull force on the at least one hook of greater than a force of gravity on the curtain assembly. Alternatively, the at least one hook of the plurality of hooks may be pulled through a curtain track opening by a pull force on the at least one hook of greater than 5 lbs. Alternatively, the at least one hook of the plurality of hooks may be pulled through a curtain track opening by a pull force on the at least one hook of greater than 10 lbs. Alternatively, the at least one hook of the plurality of hooks may be pulled through a curtain track opening by a pull force on the at least one hook of greater than 50 lbs.

It will be understood that the various embodiments and aspects described above can be combined in any combination or sub-combination without departing from the scope of this disclosure.

BRIEF DESCRIPTION OF THE DRAWINGS

The accompanying drawings are included to provide a further understanding of the embodiments of the invention and are incorporated in and constitute a part of this specification. The drawings illustrate one or more embodiment(s), and together with the detailed description serve to explain principles and operation of the various embodiments. Features and attributes associated with any of the embodiments shown or described may be applied to other embodiments shown, described, or appreciated based on this disclosure.

DETAILED DESCRIPTION

In general, the description relates to a curtain assembly 10 and a method of use of the curtain assembly 10. As described above, there are drawbacks or shortcomings of existing curtains and/or curtain assemblies- and, specifically, those used with cubicle curtains. Advantageously, aspects of the curtain assembly 10 and a method of use of the curtain assembly 10, both described in greater detail below, address the drawbacks and shortcomings of existing curtains and/or curtain assemblies. Other advantages and technical effects of the embodiments of this invention will become evident to one skilled in the art from the following description.

Referring now to the Figures, FIGS. 1-18 show the curtain assembly 10 or portions thereof. The curtain assembly 10 can take on a variety of forms, as described in greater detail below. However, it should be understood that the curtain assembly 10 can take on further alternative forms beyond those depicted in the figures. The particular form of the curtain assembly 10 should not be understood to be limited to only the depicted embodiments.

Figure 1:
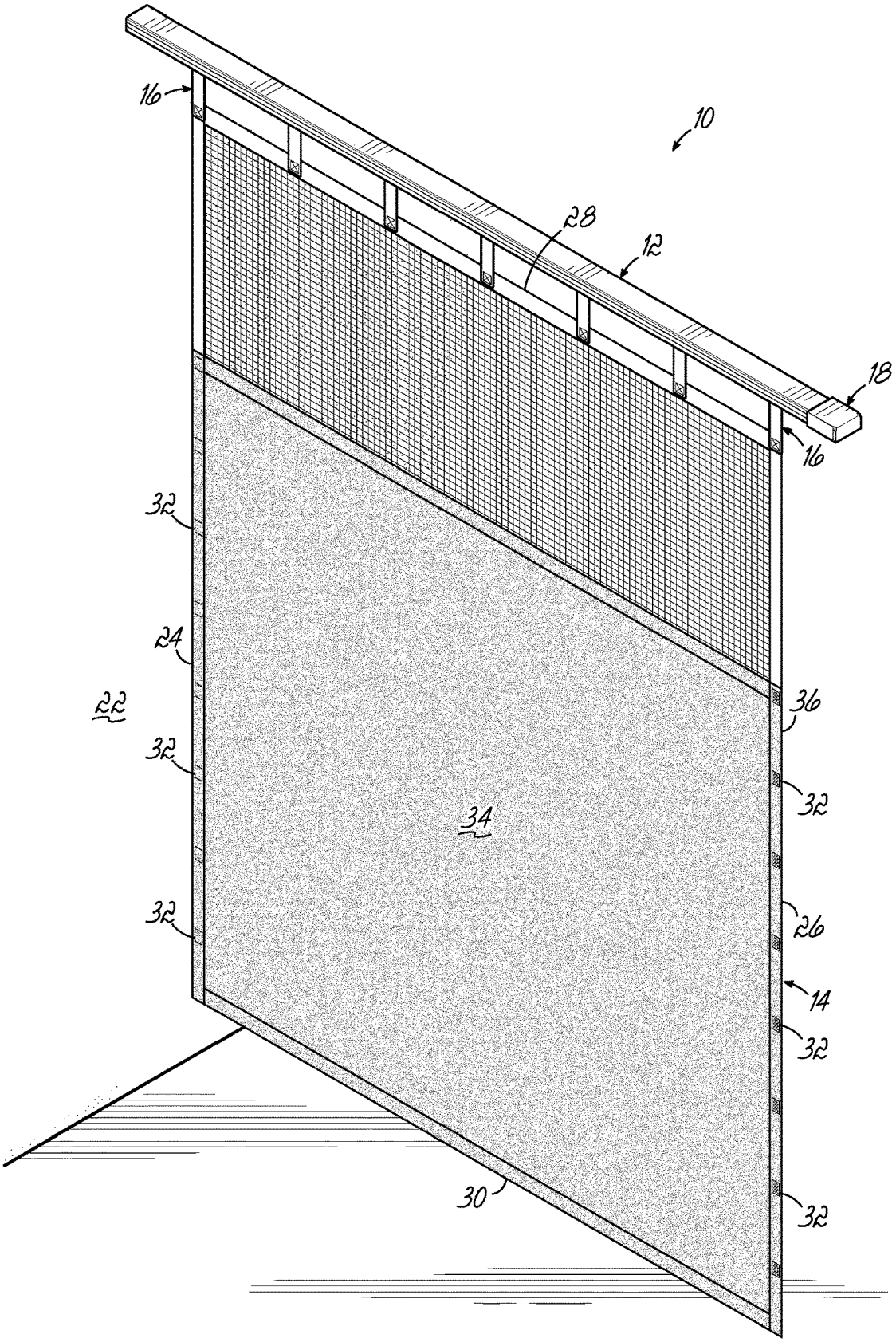
FIG. 1 is a perspective view of a curtain assembly according to an embodiment of the disclosure.
Figure 2:
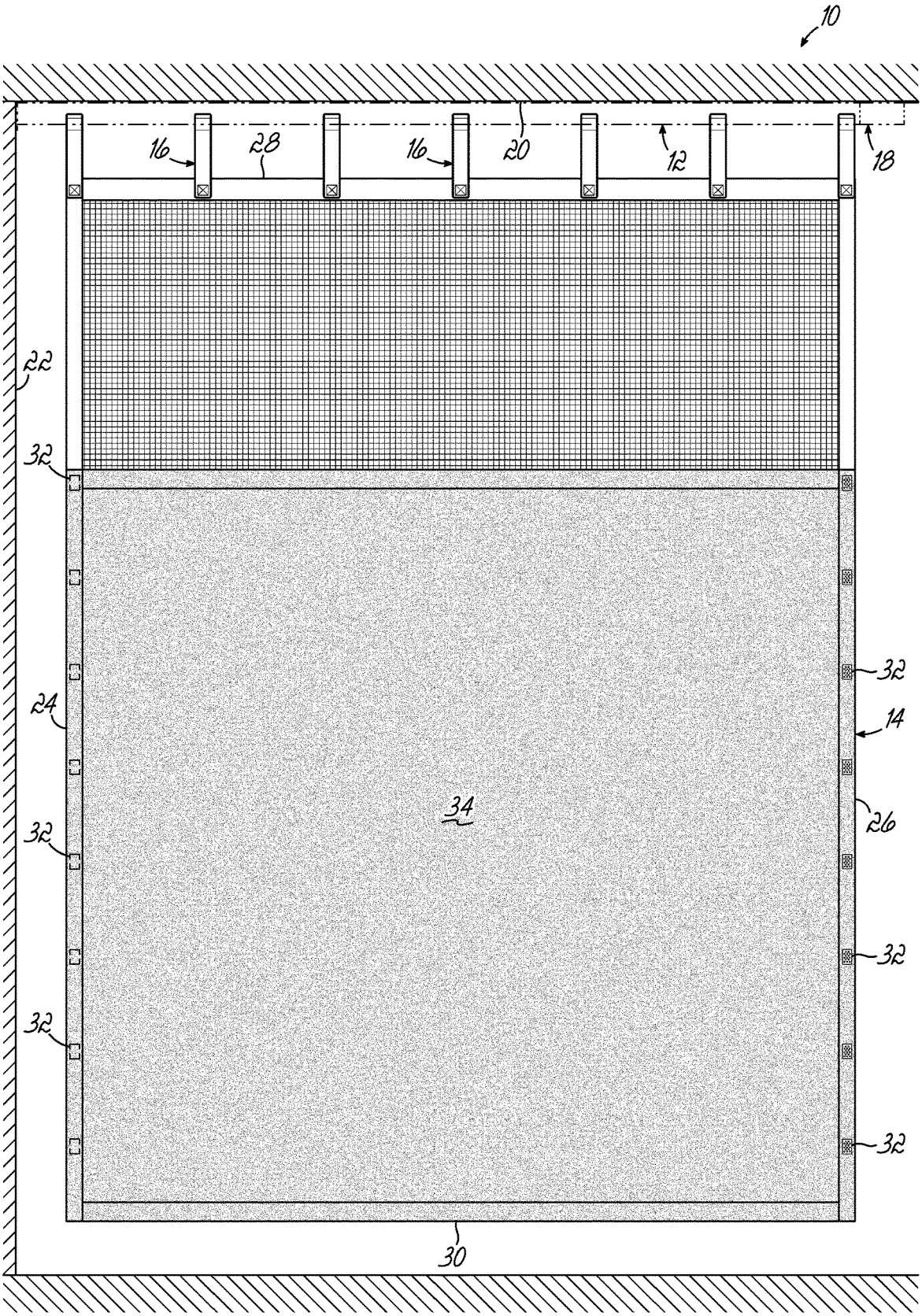
FIG. 2 is a front view of the curtain assembly of FIG. 1.

Referring now to FIGS. 1 and 2, the curtain assembly 10 generally includes a curtain track 12, a curtain 14 suspended from the curtain track 12 by a plurality of curtain hooks 16, and an end cap 18 mounted on an end of the curtain track 12 to selectively prevent the curtain hooks 16 from exiting the end of the curtain track 12. It is to be understood that alternative embodiments of the curtain assembly 10 may include more or fewer parts than those listed. For example, the curtain assembly 10 may include more than one curtain 14. The curtain track 12 is configured to be secured (directly or indirectly) to a ceiling 20 or wall 22 by one or more fasteners (e.g., screws, bolts, or similar fasteners). In an alternative embodiment, the curtain track 12 may be suspended a height below the ceiling 20 to facilitate installing and/or replacing the curtain 14. When installed, the curtain track 12 may be parallel or substantially parallel to the ceiling 20.

The curtain 14 includes a first lateral edge 24 and a second lateral edge 26. The distance between the first lateral edge 24 and the second lateral edge 26 defines a width of the curtain 14. Similarly, the curtain 14 includes a top edge 28 and a bottom edge 30. The distance between the top edge 28 and the bottom edge 30 defines a height of the curtain 14. The curtain 14 is bound and defined by the first lateral edge 24, the second lateral edge 26, the top edge 28, and the bottom edge 30. Further, the curtain 14 may include one or more panels. For example, in the depicted embodiment, the curtain 14 includes a top mesh panel and a bottom textile panel. The panels may be joined by releasable fasteners (e.g., buttons, hook and loop fastener, Block Tapey® (commercially available from Morito Co., Ltd. of Osaka, Japan, for example), etc.) or by more permanent fastening (e.g., stitching/sewing, thermal welding, ultrasonic welding, adhesive, etc.), for example. The top mesh panel may be included in order to satisfy the NFPA701 fire code, for example, that could require an open area of at least 70% along the top 18 inches of a curtain. The bottom textile panel could be made of any suitable textile material such as a woven polyester fabric or a nonwoven (such that it is selected from a set of materials that is launderable at practical conditions) or other suitable material. Particularly, the material of the bottom textile panel may be a woven, non-woven, knitted, braided, or other suitable textile material or combination thereof and any number of suitable fibers or yarns, e.g., all-natural or synthetic fibers, or a blend or combination of natural and synthetic fibers and yarns may be employed. It should be understood that the curtain 14 may include more or fewer panels than are shown. Further, it should be understood that, the panel or panels of the curtain 14 may be made of suitable alternative materials.

With continued reference to FIGS. 1 and 2, the curtain 14 may include curtain connectors 32 along the first lateral edge 24 and/or the second lateral edge 26 of the curtain 14. The curtain connectors 32 may be used to selectively secure neighboring curtains 14 to each other—to form a cubicle of curtains 14 for patient privacy, for example. The curtain connectors 32 may be located on opposing faces of the curtain. For example, in the depicted embodiment the curtain connectors 32 along the second lateral edge 26 of the curtain 14 are located on a first face 34 of the curtain 14. And the curtain connectors 32 along the first lateral edge 24 of the curtain 14 are located on a second face 36 (located diametrically opposite the first face 34—i.e., on the opposite side) of the curtain 14.

A plurality of curtain hooks 16, connected to and spaced at intervals along a top edge 28 of the curtain 14, suspend the curtain 14 from the curtain track 12. For example, a curtain hook 16 may be placed approximately every 11 inches along the top edge 28 of the curtain 14, starting at or near to the first lateral edge 24 or the second lateral edge 26 of the curtain 14. Each curtain hook 16 includes a first end 38 and a second end 40, the second end 40 located opposite the first end 38. The first end 38 of the curtain hook 16 is operatively connected to the curtain 14 adjacent the top edge 28 of the curtain 14. In the depicted embodiment, the curtain hook 16 is sewn (or otherwise attached) to the curtain 14 at the first end 38 of the curtain hook 16 so as to permanently fix the curtain hook 16 to the curtain 14. Advantageously, the curtain hooks 16 of this disclosure can be laundered with the curtain 14. Such at least saves a user from having to painstakingly remove the curtain hooks 16 from the curtain 14 before laundering the curtain 14 and then replace those same curtain hooks 16 back onto the curtain 14 after laundering the curtain 14. However, it is to be understood that the curtain 14 may be alternatively secured to the curtain 14. For example, the curtain hook 16 may be releasably secured to the curtain 14 by a fastener (e.g., hook and loop fastener, snap button(s), Block Tapey®, or a similar fastener) at the first end 38, for example. As will be described in greater detail below, the second end 40 of the curtain hook 16 is configured to interface with the curtain track 12 to slidably secure the curtain 14 to the curtain track 12. Advantageously, the curtain hooks 16 of this disclosure are also configured to generate less noise when conveying along the curtain track 12. Such is beneficial at least to patient wellbeing and recovery in healthcare settings where cubicle curtains are often used.

Figure 5:
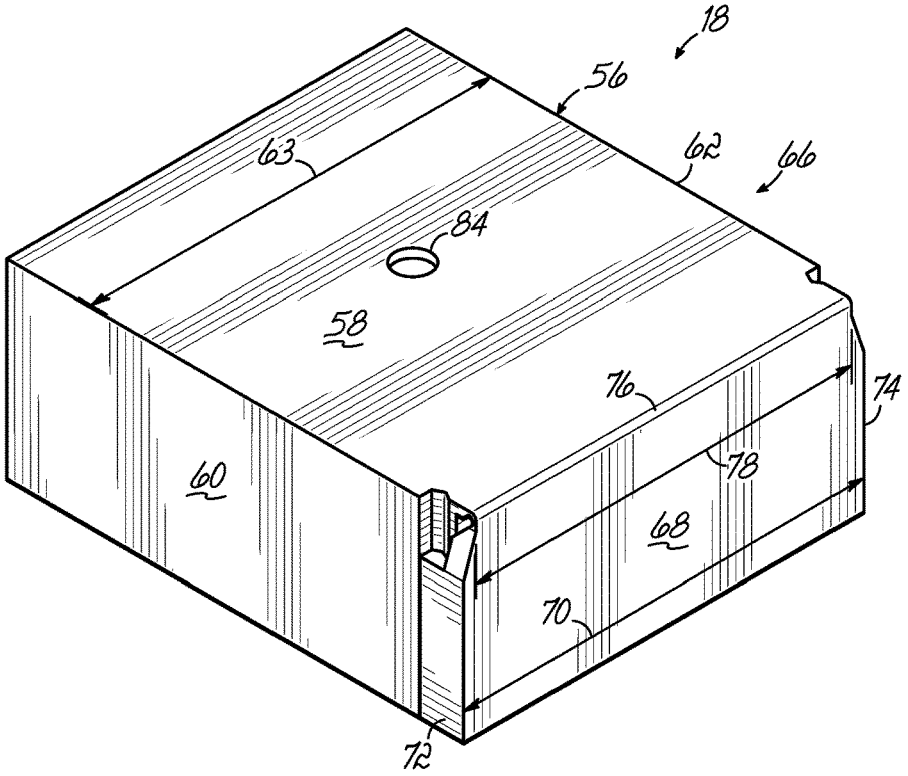
FIG. 5 is a top perspective view of an end cap according to an embodiment of the disclosure, showing a flange in a closed position.
Figure 6:
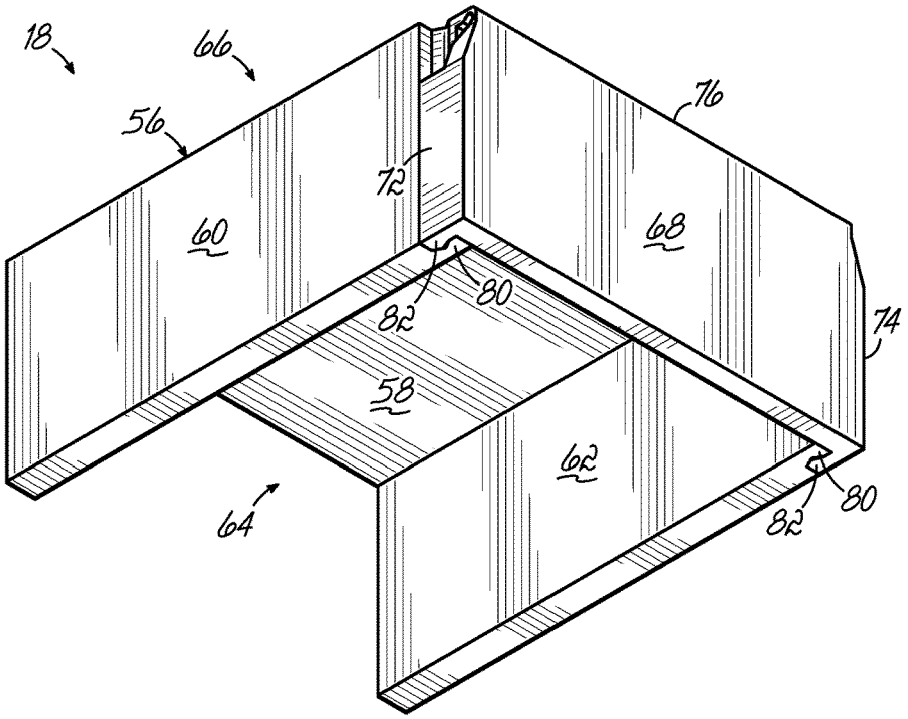
FIG. 6 is a bottom perspective view of the end cap of FIG. 5.

With continued reference to FIGS. 1 and 2, an end cap 18 is shown on an end of the curtain track 12 to prevent the curtain hooks 16 from exiting the end of the curtain track 12. Though only one end cap 18 is shown in FIGS. 1 and 2, it should be understood than an end cap 18 could be located at either end or both ends of the curtain track 12. In the depicted embodiment, the end cap 18 is located adjacent to and surrounds an exterior portion of one of the ends of the curtain track 12. As will be described in greater detail below, a portion of the end cap 18 is configured to selectively transition between an open position (FIGS. 7 and 8) and a closed position (FIGS. 5 and 6). In the closed position, the end cap 18 restricts the curtain hooks 16 from entering or exiting the end of the curtain track 12 (e.g., the end of the curtain track 12 that the end cap 18 is mounted on). Importantly, the end cap 18 is a single piece or monolithic construction—in contrast to known track caps, which are generally at least two piece construction. With a single piece or monolithic construction, the end cap 18 has no loose parts to fall or be lost by a user and also requires no specialized hand tools to open or close the end cap 18. Advantageously, the single piece or monolithic construction of the end cap 18 facilitates quick and easy removal of the curtain 14 from the curtain track 12. A user need not fumble with specialized hand tools or keep track of small, loose parts when transitioning the end cap 18 between the open position and the closed position in order to install or replace the curtain 14. For example, installing a curtain in a typical, known curtain system may take approximately 4 minutes, whereas installing a curtain 14 in the disclosed curtain assembly 10 (i.e., with the disclosed end cap 18 and curtain hooks 16) may take approximately 40 seconds, according to testing conducted by the inventors of this disclosure.

Figure 3:
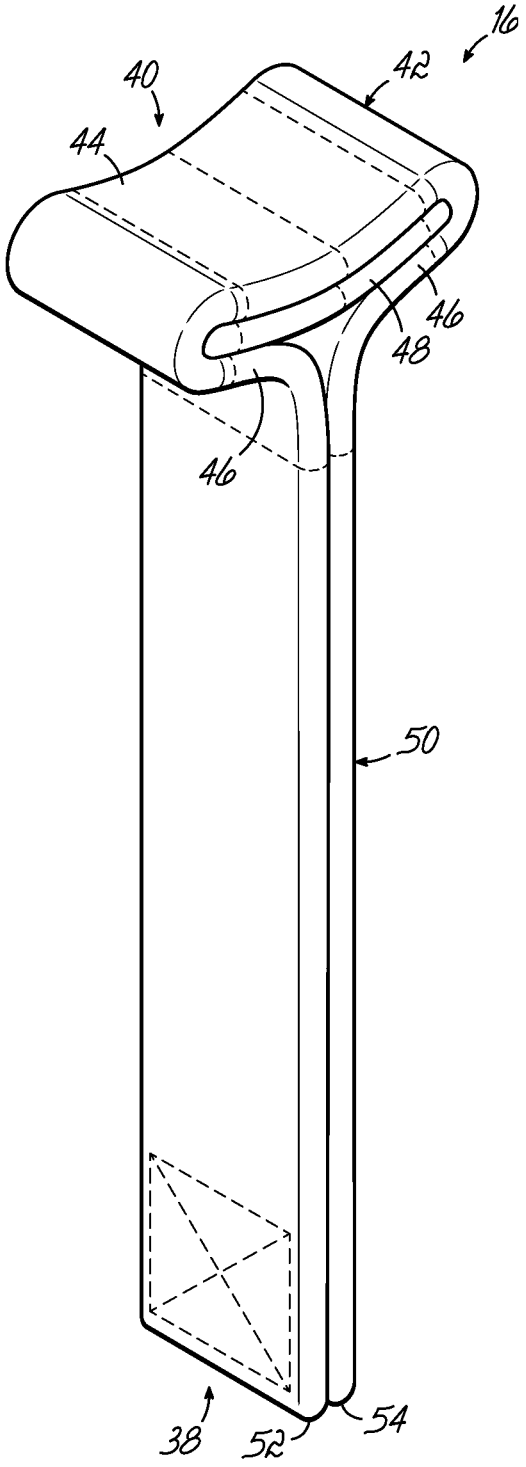
FIG. 3 is a perspective view of a curtain hook according to an embodiment of the disclosure.
Figure 4:
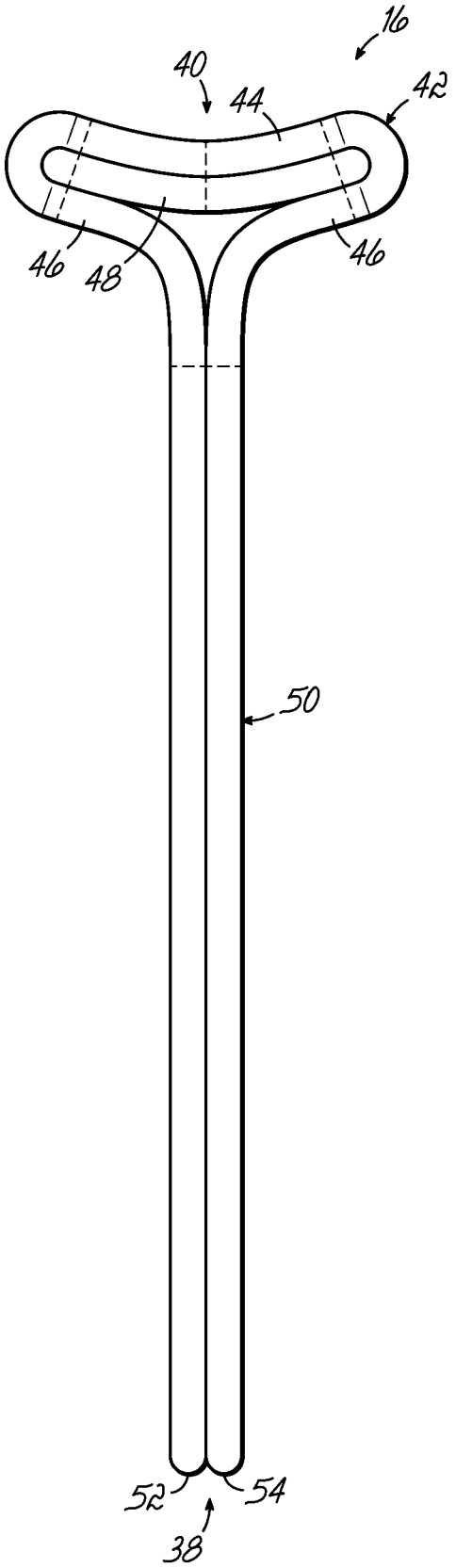
FIG. 4 is a front view of the curtain hook of FIG. 3.

Referring now to FIGS. 3 and 4, the figures show one embodiment of the curtain hook 16. The curtain hook 16 can take on a variety of forms, as described in greater detail below with respect to FIGS. 14, 15, and 18. However, it should be understood that the curtain hook 16 can take on further alternative forms beyond those depicted in the figures. The particular form of the curtain hook 16 should not be understood to be limited to only the depicted embodiments. As described above, the curtain hook 16 connects the curtain 14 to the curtain track 12 and generally includes a first end 38 that connects to the curtain 14 and a second end 40 that interacts with the curtain track 12. To facilitate interaction with the curtain track 12, the second end 40 of the curtain hook 16 features a hook head 42. The hook head 42 is shaped and dimensioned to be secured within the curtain track 12. Specifically, the hook head 42 extends outwardly in both lateral directions to form arms that serve to retain the curtain hook 16 within the curtain track 12. The width of the hook head 42 may be between 25 mm and 32 mm. Particularly, the width of the hook head 42 may be 29 mm. This particular use of "width" should be understood to mean the distance from an end of one arm of the hook head 42 to the end of the other arm of the hook head 42. While a particular form of the hook head 42 is shown in FIGS. 3 and 4, it is to be understood that alternative forms of the hook head 42 (with alternative dimensions) are envisioned.

The hook head 42 generally features a top layer 44 and a bottom layer 46. The top layer 44 and the bottom layer 46 are secured together to form the hook head 42. The top layer 44 and the bottom layer 46 of the hook head 42 may be secured together by various fastening means. In the depicted embodiment, the top layer 44 and the bottom layer 46 are secured by stitching. The stitches closest to each lateral edge of the hook head 42 may be approximately 0.625 inches apart from each other. The top layer 44 and the bottom layer 46 may be alternatively fastened together by bar tacking, thermal welding, ultrasonic welding, or adhesive, for example. It should be understood that other fastening elements are possible.

With continued reference to FIGS. 3 and 4, the hook head 42 is substantially T-shaped. It should be understood that the hook head 42 can be alternatively shaped without departing from the inventive aspects of this disclosure. For example, as described below in relation to FIGS. 14 and 15, the hook head 42 may alternatively be substantially Y-shaped. The substantially T-shaped hook head 42 is configured to retain the second end 40 of the curtain hook 16 within the curtain track 12 while avoiding catching on a fastener which secures the curtain track 12 to the ceiling 20 or wall 22 and which may extend into the curtain track 12. Particularly, the middle portion of the T-shaped hook head 42 is slightly depressed downwardly so as to avoid a fastener which may inadvertently stick out within a top region of the curtain track 12. The depth of the depression may be between 3 mm and 5 mm, for example. Particularly, the depth of the depression may be 3 mm.

The T-shaped hook head 42 is supported by a reinforcement layer 48 located between the top layer 44 and the bottom layer 46 of the hook head 42. The reinforcement layer 48 is secured to the top layer 44 of the hook head 42. In the depicted embodiment, the reinforcement layer 48 is secured by stitching. The stitching may be located approximately halfway between the stitching that secures the top layer 44 to the bottom layer 46. Alternatively, the reinforcement layer 48 may be secured to the top layer 44 by bar tacking, thermal welding, ultrasonic welding, or adhesive, for example. It should be understood that other fastening means are possible. The reinforcement layer 48 may be made of the same material as the rest of the curtain hook 16 or, alternatively, the reinforcement layer 48 may be a different, suitable material. For example, the reinforcement layer 48 may be rigid plastic, Block Tapey®, or another suitable material. Additionally, it should be understood that a T-shaped hook head 42 could be formed with or without the reinforcement layer 48. However, the reinforcement layer 48 adds additional rigidity and structure to the hook head 42.

With continued reference to FIGS. 3 and 4, extending away from the hook head 42, the curtain hook 16 includes a hook body 50. The hook body 50 is dimensioned such that the hook body 50 protrudes below the curtain track 12 when the curtain hook 16 is inserted into the curtain track 12. For example, the hook body 50 may be between 3.5 and 4.0 inches long. Particularly, the hook body 50 may be 3.75 inches long. The hook body 50 terminates in the first end 38 of the curtain hook 16. In the depicted embodiment, the first tail 52 and the second tail 54 of the hook body 50 are shown to be substantially the same length. However, it should be understood that the first tail 52 and the second tail 54 of the hook body 50 can be of differing lengths without departing from the inventive aspects of this disclosure. For example, the first tail 52 may be longer or shorter than the second tail 54, even substantially so. Similarly, the second tail 54 may be longer or shorter than the first tail 52, even substantially so. One or both of the first tail 52 and the second tail 54 can be secured to the curtain 14, as will be described in greater detail below.

The curtain hook 16 may be constructed of a textile material. Specifically, the curtain hook 16 may be constructed from a textile material such as nylon or polyester. The curtain hook 16 could alternatively be made of cotton or polypropylene, for example, or another suitable material. The material that the curtain hook 16 is constructed may be suitable to withstand one or more industrial laundering cycles. The material may be a woven, non-woven, knitted, braided, or other suitable textile material or combination thereof and any number of suitable fibers or yarns, e.g., all-natural or synthetic fibers, or a blend or combination of natural and synthetic fibers and yarns may be employed. The thickness of the material used to form the curtain hook 16 may be between 1.8 mm and 2.2 mm. Particularly, the thickness of the material may be 2.0 mm. The width of the curtain hook 16 may be 17 mm. In an alternative embodiment, the width of the curtain hook 16 may be 38 mm.

With continued reference to FIGS. 3 and 4, advantageously, a textile construction allows for the curtain hook 16 to be laundered with the curtain 14. In other words, a textile curtain hook 16 may be permanently affixed to the curtain 14 such that the curtain 14 and the curtain hooks 16 may be laundered together. This eliminates the need for removing the curtain hooks 16 from the curtain 14 prior to laundering, which can be a time-consuming and difficult task at least because of the suspension of the curtain 14 from the curtain track 12 by the curtain hooks 16 at or near to the ceiling 20, for example. A further advantage of textile curtain hooks 16 is a reduction in noise generated by conveying the curtain 14 along the curtain track 12. As described above, conveying a curtain 14 with conventional hooks and/or carriers can generate substantial noise and impact patient wellbeing. For example, the noise generated by conveying a curtain with conventional hooks and/or carriers may be or be greater than 80 dB at peak (e.g., a similar noise level to using a blender or hair dryer, loud traffic, or city street sounds). Use of a textile curtain hook 16 can substantially reduce the amount of noise generated. Particularly, use of one textile curtain hook 16 was measured to be approximately 65 dB at peak (e.g., a similar noise level to normal talking or laughing). In this example, the curtain with conventional hooks and/or carriers is approximately three times the perceived sound volume as the curtain 14 with textile curtain hooks 16. However, it should be understood that the curtain hook 16 could be constructed from alternative materials. For example, the curtain hook 16 may be constructed of a readily disposable material so that the curtain 14 and attached curtain hooks 16 could be thrown out together when the curtain 14 is finished with use.

Figure 14:
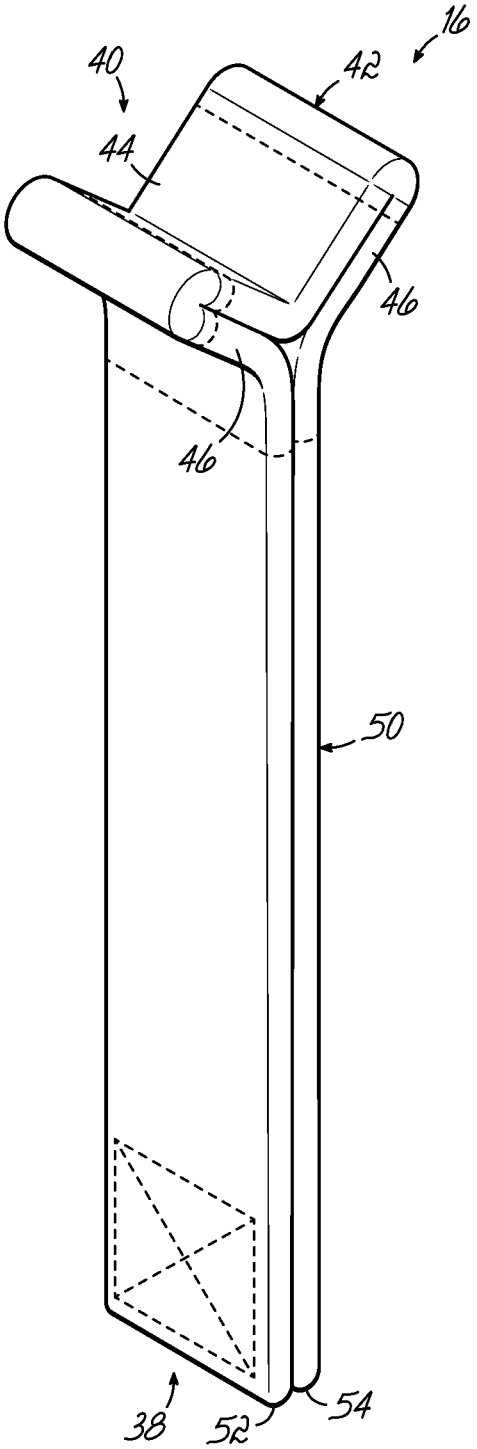
FIG. 14 is a perspective view of a curtain hook according to an alternative embodiment of the disclosure.
Figure 15:
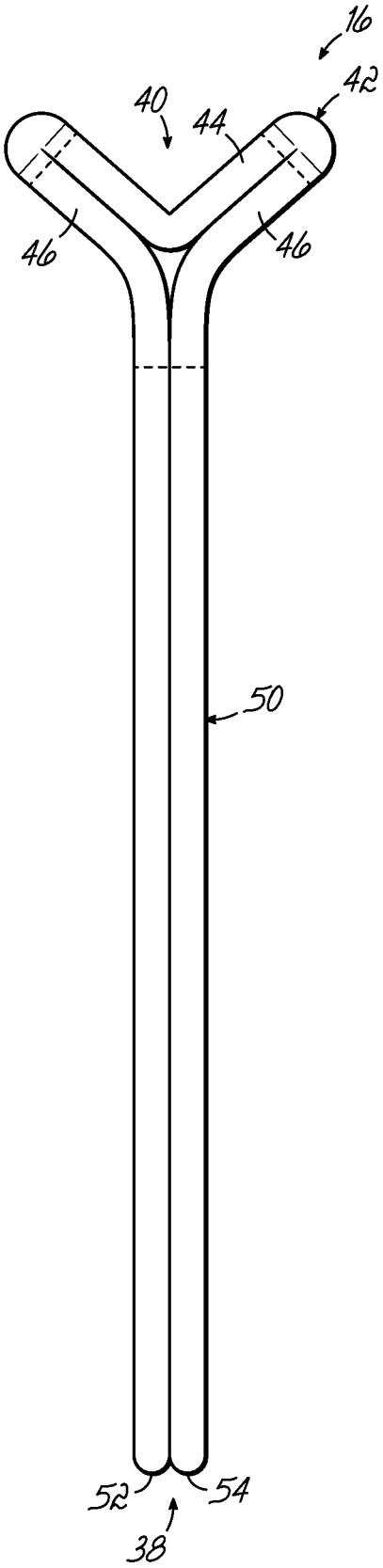
FIG. 15 is a front view of the curtain hook of FIG. 14.

Regardless of the particular material (or materials) of the curtain hook 16, the curtain hook 16 may be constructed so as to form a single contiguous (e.g., unitary or monolithic) piece as opposed to known curtain hooks and/or carriers which are frequently two or more separate pieces. Advantageously, a single piece construction reduces the complexity of the curtain hook 16 and minimizes the chance for a part to go missing during removal of the curtain 14 and/or curtain hooks 16 from the curtain track 12. Further, the curtain hook 16 may be constructed of a single continuous piece of material. Such is shown in FIGS. 14 and 15, for example. Such a construction advantageously reduces the complexity of manufacturing the curtain hook 16.

Referring now to FIGS. 5-8, the figures show an embodiment of the end cap 18. The end cap 18 can take on a variety of forms, as described in greater detail below. However, it should be understood that the end cap 18 can take on further alternative forms beyond those depicted in the figures. The particular form of the end cap 18 should not be understood to be limited to only the depicted embodiments. Generally, the end cap 18 is dimensioned so as to fit over an end of the curtain track 12. The end cap 18 enables temporary, reversible access to the an end of the curtain track 12 for insertion and/or removal of curtain hooks 16 without requiring use of specialized hand tools and without the need for a user to keep track of loose track cap parts that would need to be reinstalled with each curtain 14 change out. The end cap 18 generally speeds up the process of gaining access to an end of the curtain track 12 and also prevents loss of separated parts during the curtain 14 changing process.

The end cap 18 generally includes an end cap body 56. The end cap body 56 includes an end wall 58, a first side wall 60, and a second side wall 62. The first side wall 60 and the second side wall 62 are connected to and extend generally in the same direction from the end wall 58. The end wall width 63 is defined by a distance between the first side wall 60 and the second side wall 62 along a surface of the end wall 58. In the depicted embodiment, the first side wall 60 and the second side wall 62 extend perpendicularly (or, at least, substantially perpendicularly) from the end wall 58; however, it should be understood that the first side wall 60 and the second side wall 62 could extend from the end wall 58 at oblique angles, respectively, to the end wall 58, for example, without departing from the inventive aspects of this disclosure. The end cap body 56 defines an inner periphery 64 and an outer periphery 66 of the end cap body 56. The inner periphery 64 of the end cap body 56 is configured to face towards the curtain track 12 when the end cap 18 is installed on the curtain track 12. More specifically, the inner periphery 64 may be arranged in a confronting relationship with the exterior of the curtain track 12. The outer periphery 66 of the end cap body 56 is configured to face away from the curtain track 12 when the end cap 18 is installed on the curtain track 12.

Figure 7:
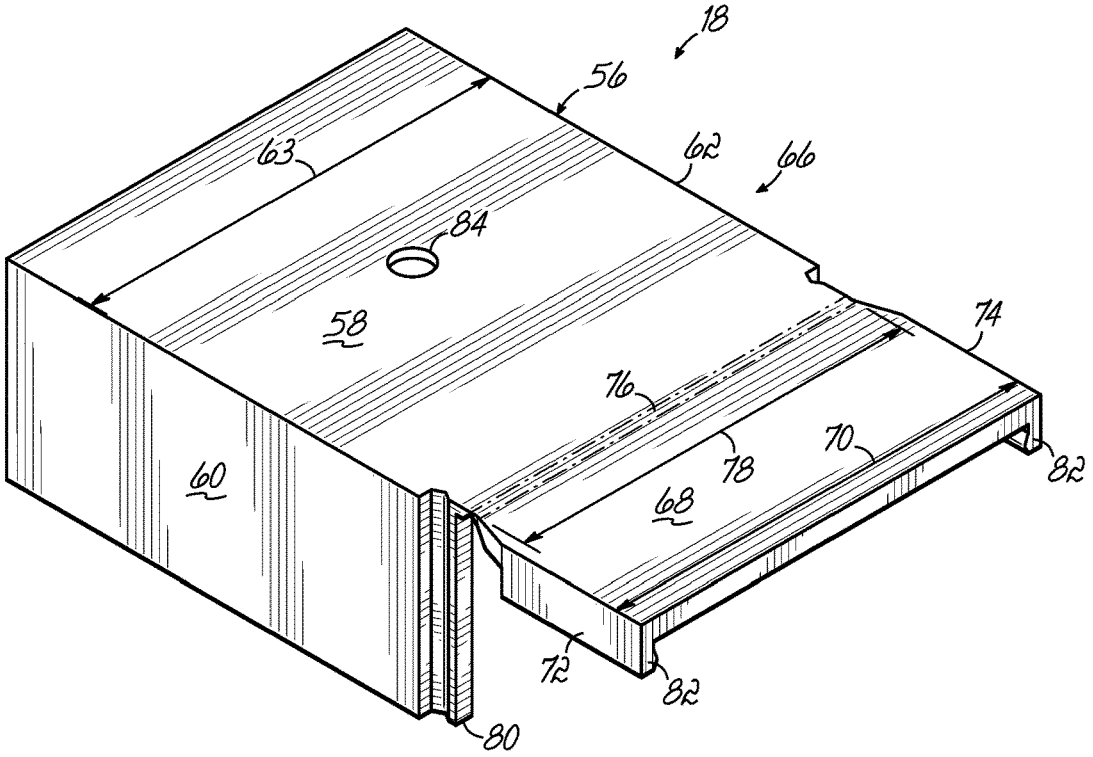
FIG. 7 is a top perspective view of the end cap of FIG. 5, showing the flange in an open position.
Figure 8:
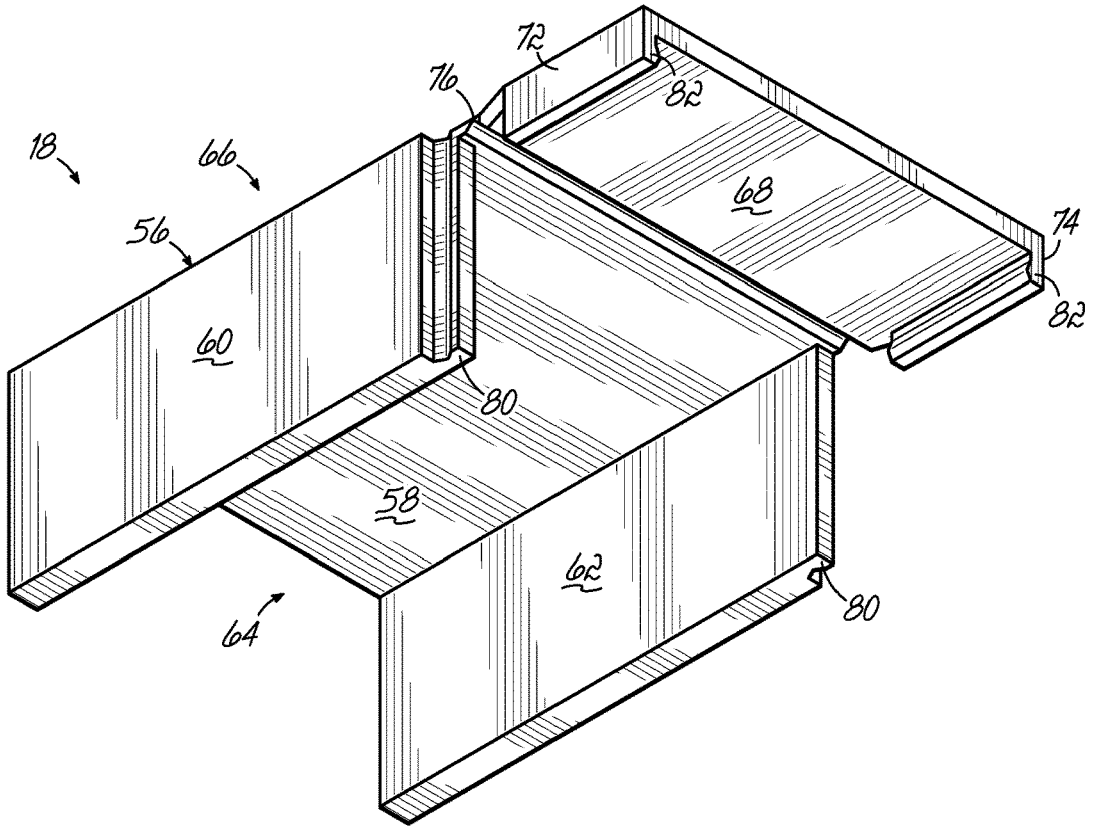
FIG. 8 is a bottom perspective view of the end cap of FIG. 7.

With continued reference to FIGS. 5-8, the end cap 18 generally includes a flange 68 pivotally connected to the end cap body 56. The flange 68 extends a flange width 70 between a first lateral edge 72 of the flange 68 and an opposite second lateral edge 74 of the flange 68. The flange 68 is configured to selectively transition between an open position (e.g., in which curtain hooks 16 can enter or exit the end of the curtain track 12, as shown in FIGS. 7 and 8) and a closed position (e.g., in which curtain hooks 16 cannot enter or exit the end of the curtain track 12, as shown in FIGS. 5 and 6). In the closed position, the flange 68 is arranged in a substantially parallel orientation to an end face of the curtain track 12. In the open position, the flange 68 may be arranged at an angle to the end face of the curtain track 12. For example, the flange 68 could be arranged perpendicularly to the end face of the curtain track 12 or at an oblique angle to the end face of the curtain track 12. In the depicted embodiment, the flange 68 is pivotally connected to the end wall 58 of the end cap body 56; however, it should be understood that the flange 68 could be alternatively arranged (e.g., connected) without departing from the inventive aspects of the disclosure.

In the depicted embodiment, the flange 68 is pivotally connected to the end cap body 56 by a living hinge 76. The living hinge 76 is formed as an integral part of the end cap 18 such that the end cap body 56 and the flange 68 are pivotally connected without need for an additional part which would need to be separately installed onto the end cap 18. Advantageously, the living hinge 76 feature allows for the end cap 18 to be manufactured as a single piece of unitary construction, e.g., as a monolithic construction. Such formation at least facilitates efficient manufacturing. No additional assembly of the end cap 18 is required. Further, the inclusion of the living hinge 76 allows for the entirety of the end cap 18 to be made of the same material. Such at least further facilitates efficient manufacturing. In the depicted embodiment, the living hinge width 78 is substantially coextensive with the end wall width 63 and the flange width 70. However, it should be understood that the living hinge width 78 may vary (e.g., be shorter or longer than is depicted) without departing from the inventive aspects of this disclosure.

With continued reference to FIGS. 5-8, the flange 68 may be selectively secured to the end cap body 56 in a closed position by complementary features on the flange 68 and the end cap body 56. In the depicted embodiment, each of the first side wall 60 and the second side wall 62 include a lip portion 80 at an end of the end cap body 56 closest to the flange 68. Similarly, the flange 68 includes a catch feature 82 located at a first lateral edge 72 of the flange 68 and at a second lateral edge 74 of the flange 68. When in the closed position, the catch features 82 of the flange 68 mate (or otherwise interface with) with the lip portions 80 of the end cap body 56 to selectively secure the flange 68 in the closed position. As described above, in the closed position curtain hooks 16 are restricted from entering or exiting the end of the curtain track 12.

The end cap body 56 may also include a fastener aperture 84. The fastener aperture 84 may be a molded feature introduced during manufacture or may be a feature added after manufacture. In depicted embodiment, the end cap body 56 includes a single fastener aperture 84 located in approximately the middle and center of the end wall 58 of the end cap body 56. It should be understood that, in alternative embodiments, the end cap body 56 may include more or fewer fastener apertures 84 than is shown. For example, the end cap body 56 may include no fastener aperture 84 and the end cap 18 may instead be held in place at the end of the curtain track 12 by a transition and/or interference and/or friction fit. Further, it should be understood that the more or fewer fastener apertures 84 could be alternatively located on the end cap body 56. For example, the fastener aperture 84 could be located on a first or second side wall 60, 62 of the end cap body 56 or in a location other than the middle and center of the end wall 58.

Figure 9:
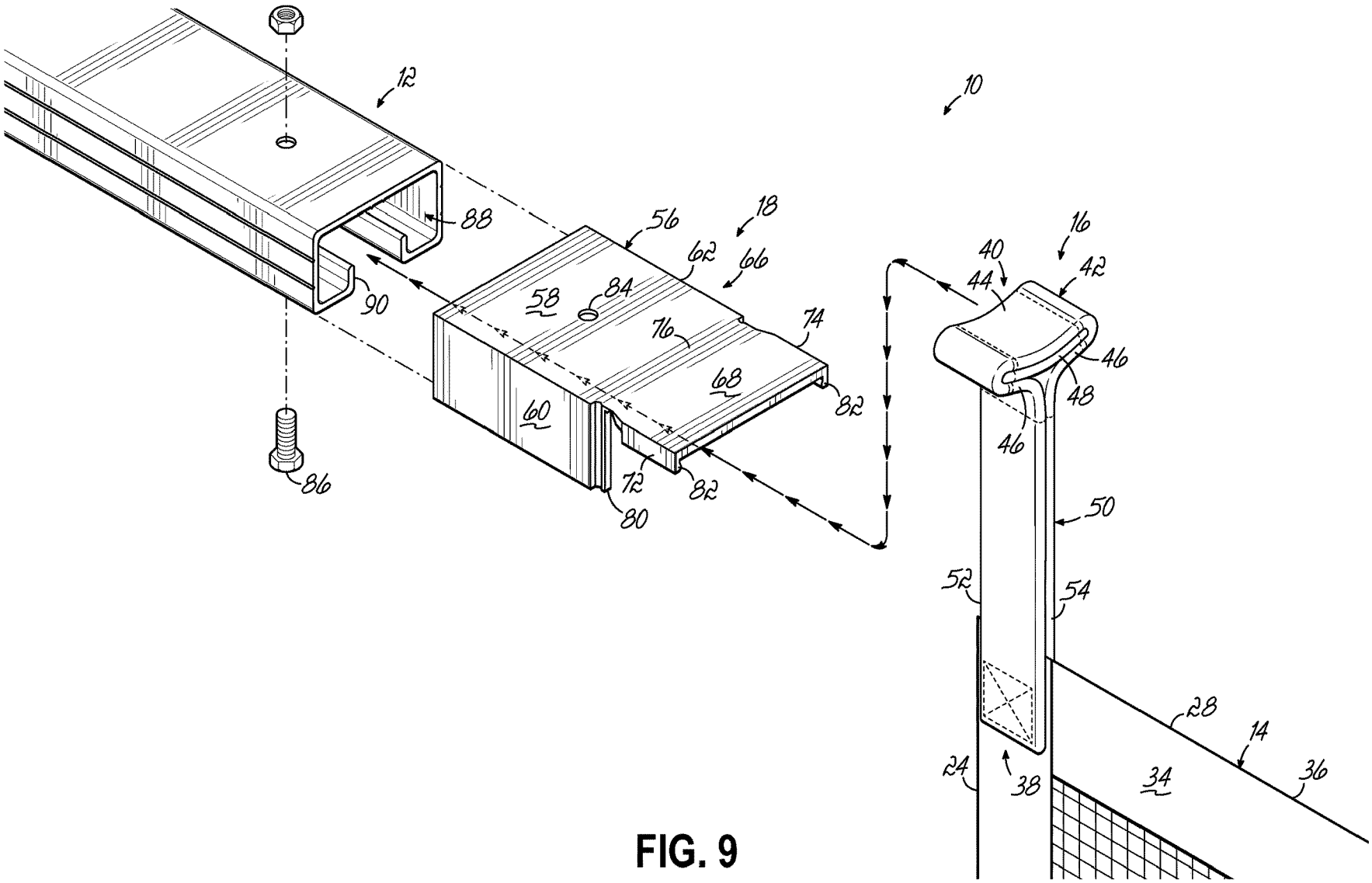
FIG. 9 is an exploded detail view of the curtain assembly of FIG. 1.
Figure 10:
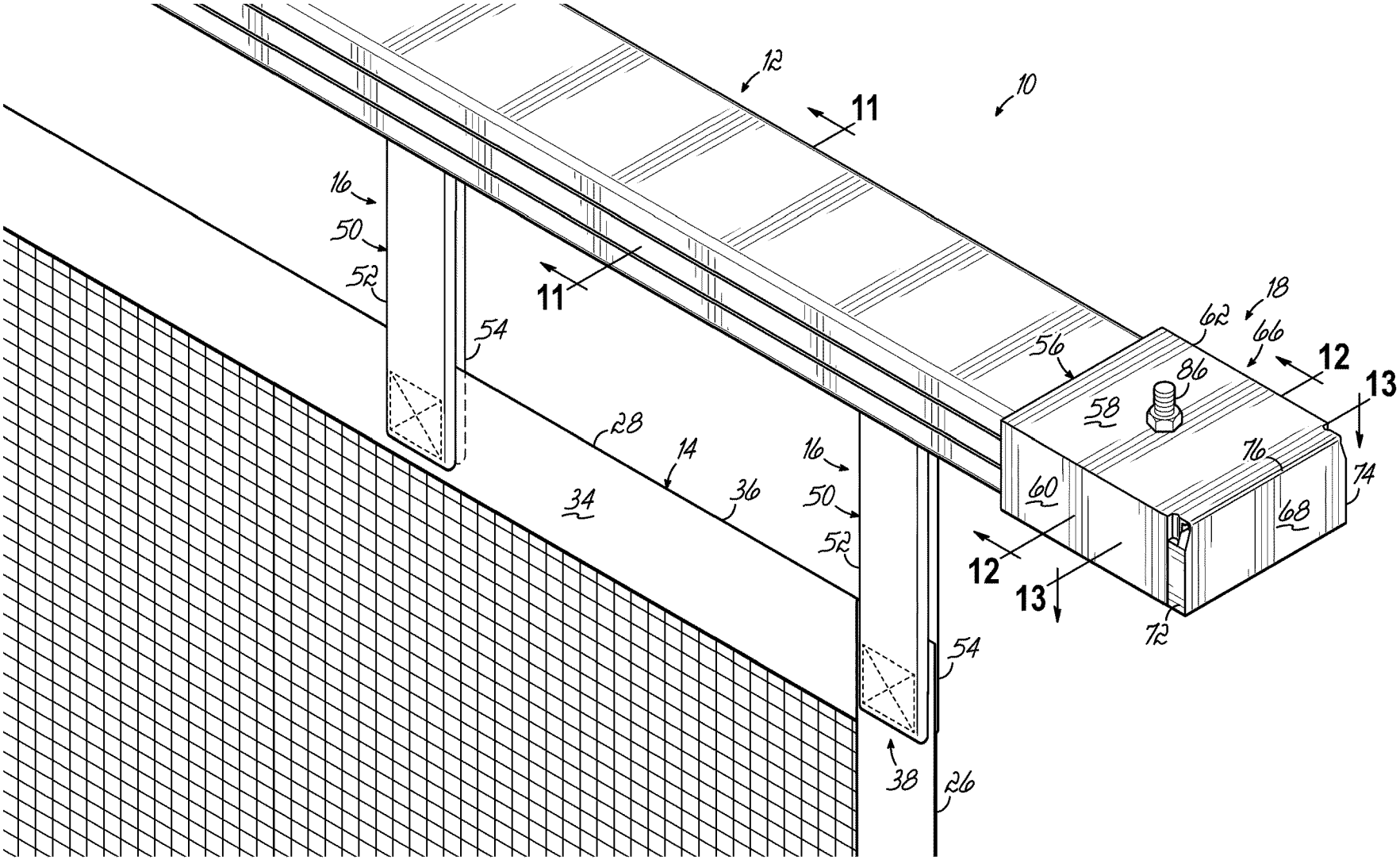
FIG. 10 is a further detail view of the curtain assembly of FIG. 1.

Referring now to FIGS. 9 and 10, the figures show an exploded (FIG. 9) and assembled (FIG. 10) curtain assembly 10. As shown, a mechanical fastener 86 may pass through both the curtain track 12 and the end wall 58 of the end cap 18 to releasably secure the end cap 18 to the curtain track 12 (and possibly also the ceiling 20). Specifically, in the depicted embodiment, the mechanical fastener 86 passes through the curtain track 12 and the fastener aperture 84 of the end cap 18 to releasably secure the end cap 18 to the curtain track 12. The mechanical fastener 86 may be a screw, bolt, or similar fastener. Further, the same mechanical fastener 86 that secures the end cap 18 to the curtain track 12 may also secure the curtain track 12 to the ceiling 20, if the curtain track 12 is attached to the ceiling 20. In such a case, a nut (as shown in FIGS. 9 and 10), or similar structure, would be unnecessary. However, a nut, or similar structure, may be used in conjunction with the mechanical fastener 86 to secure the end cap 18 to the curtain track 12 if the curtain track 12 is secured to a wall 22 instead of to the ceiling 20 or if the curtain track 12 is suspended a distance below the ceiling 20. As described above, the fastener aperture 84 does not necessarily have to be located in the position shown in FIGS. 9 and 10. Alternatively, the end cap 18 may be frictionally engaged using a transition or interference fit with the end of the track 12 to maintain the end cap 18 in position, and such a frictional engagement should be designed to avoid having the end cap 18 accidentally dislodged when a curtain 14 or the hooks 16 are run into the flange 68 during normal use of the curtain 14.

Further, as shown in FIG. 10, when the end cap 18 is secured to the curtain track 12, the first side wall 60 of the end cap 18 overlaps an exterior of the curtain track 12. Particularly, the first side wall 60 overlaps the exterior of the curtain track 12 for a majority of a length and a width of the first side wall 60. Similarly, the second side wall 62 of the end cap 18 also overlaps an exterior of the curtain track 12. Particularly, the second side wall 62 overlaps the exterior of the curtain track 12 for a majority of a length and a width of the second side wall 62. It should be understood that the first and second side walls 60, 62 of the end cap 18 need not necessarily overlap the exterior of the curtain track 12 or need not necessarily overlap the exterior of the curtain track 12 for a majority of a length and a width of the first and/or second side walls 60, 62.

With continued reference to FIGS. 9 and 10, the curtain 14 includes a first face 34 and a second face 36. The second face 36 of the curtain 14 is located diametrically opposite (e.g., on the opposite side of) the first face 34. A curtain hook 16 may be operatively connected to at least one of the first face 34 and the second face 36 of the curtain 14. For example, if one of the first tail 52 or the second tail 54 of the hook body 50 is longer than the other, only the longer of the tails 52, 54 may be operatively connected to the curtain 14 on either the first or second face 34, 36 of the curtain. In the depicted embodiment, the curtain hooks 16 are operatively connected to both the first face 34 and the second face 36 of the curtain 14.

For example, and as shown in FIGS. 9 and 10, the first tail 52 of the hook body 50 is operatively connected to the first face 34 of the curtain 14 and the second tail 54 of the hook body 50 is operatively connected to the second face 36 of the curtain 14. In an alternative embodiment, both the first tail 52 and the second tail 54 may be operatively connected to the same face-either the first face 34 or the second face 36 of the curtain 14. As described above, in the depicted embodiment, the curtain hook 16 is operatively connected to the curtain 14 by sewing so as to permanently fix the curtain hook 16 to the curtain 14. However, it is to be understood that the curtain 14 may be alternatively secured to the curtain 14. For example, the curtain hook 16 may be releasably secured to the curtain 14 by a fastener (e.g., hook and loop fastener, snap button(s), Block Tapey®, or a similar fastener), for example.

Figure 11:
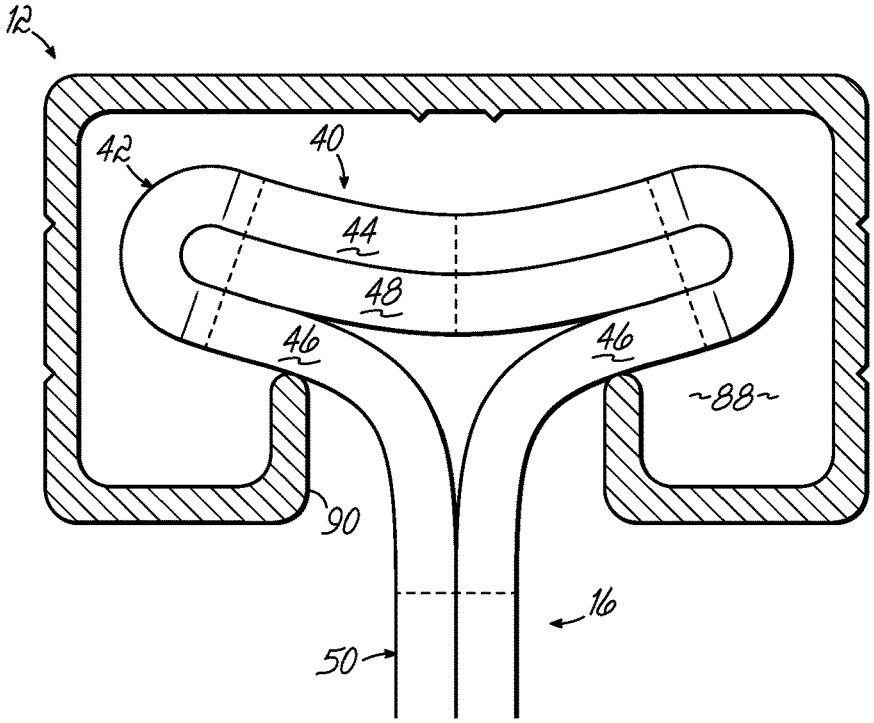
FIG. 11 is a side cross-sectional view of the curtain assembly shown in in FIG. 10 taken along line 11-11.
Figure 12:
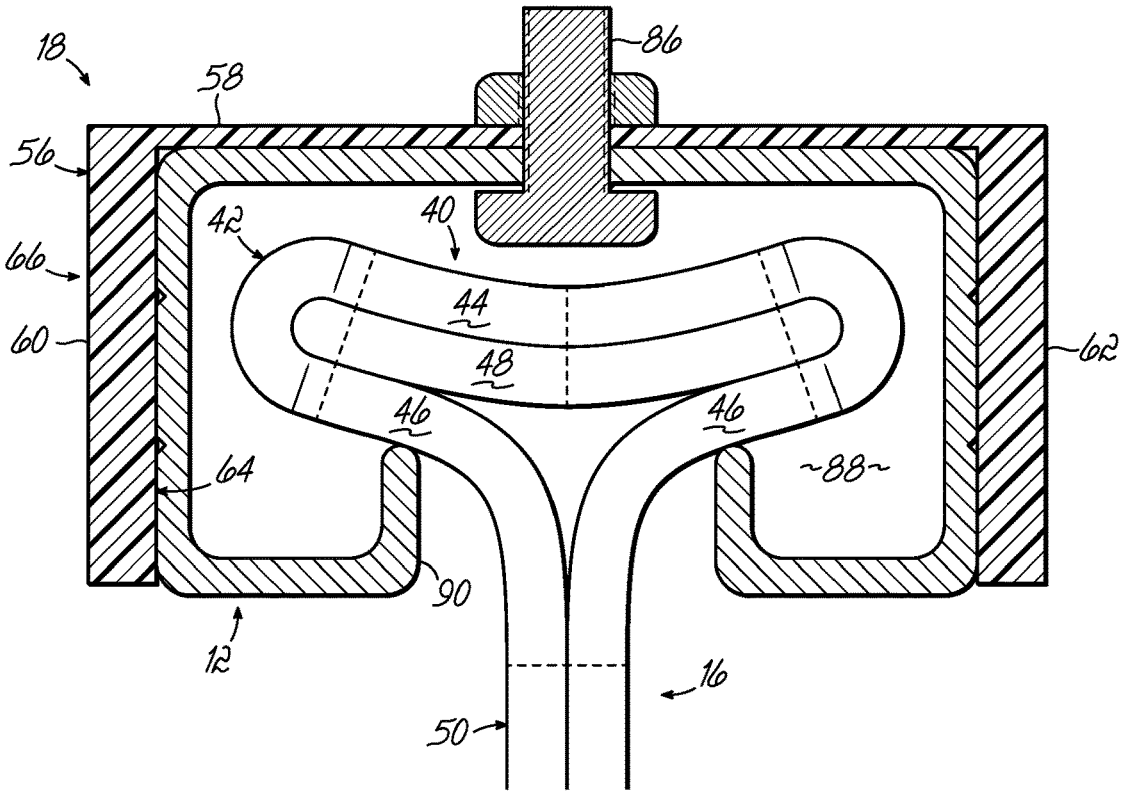
FIG. 12 is a side cross-sectional view of the curtain assembly shown in in FIG. 10 taken along line 12-12.

Referring now to FIGS. 11 and 12, the figures show cross-sectional views of the curtain assembly 10. In one embodiment, the curtain track 12 may be approximately 1.735 inches wide and 0.75 inches tall. It is to be understood that the curtain track 12 could be alternatively dimensioned. For example, the curtain track 12 could be 1.40 inches wide and 0.82 inches tall or 1.35 inches wide and 0.75 inches tall. Regardless of the particular dimensions of the curtain track 12, the end cap 18 is dimensioned to fit over an end of the curtain track 12. As shown, the curtain track 12 includes a cavity 88 for receiving the curtain hook 16 (particularly, for receiving the hook head 42 at the second end 40 of the curtain hook 16). The hook head 42 of the curtain hook 16 is dimensioned to fit inside of the cavity 88 of the curtain track 12. The cavity 88 extends along a length of the curtain track 12 such that the hook heads 42 of the curtain hooks 16 can slide within the cavity 88 and along the curtain track 12 for the length of the curtain track 12 to thereby move the curtain 14 during use along the curtain track 12. Due to the structure of the curtain track 12 as well as the stiffness (rigidity) and structure of the curtain hooks 16, the curtain hooks 16 are designed to be successfully retained within the curtain track 12.

Further, as best shown in FIG. 12 (and as described above), the mechanical fastener 86 passes through both the end cap 18 and the curtain track 12 and secures the end cap 18 to the curtain track 12. The hook head 42 of the curtain hook 16 is configured (e.g., shaped) such that the hook head 42 avoids the mechanical fastener 86 which sticks out into the cavity 88 of the curtain track 12. Particularly, the middle portion of the T-shaped hook head 42 includes a depression (as described above) that avoids the portion of the mechanical fastener 86 that extends into the cavity 88 of the curtain track 12. It should be understood that the shape of the curtain hook 16 (and, particularly, the hook head 42) may differ (e.g., be a Y-shape as in FIGS. 14 and 15) and still accomplish the above-noted function.

Figure 13:
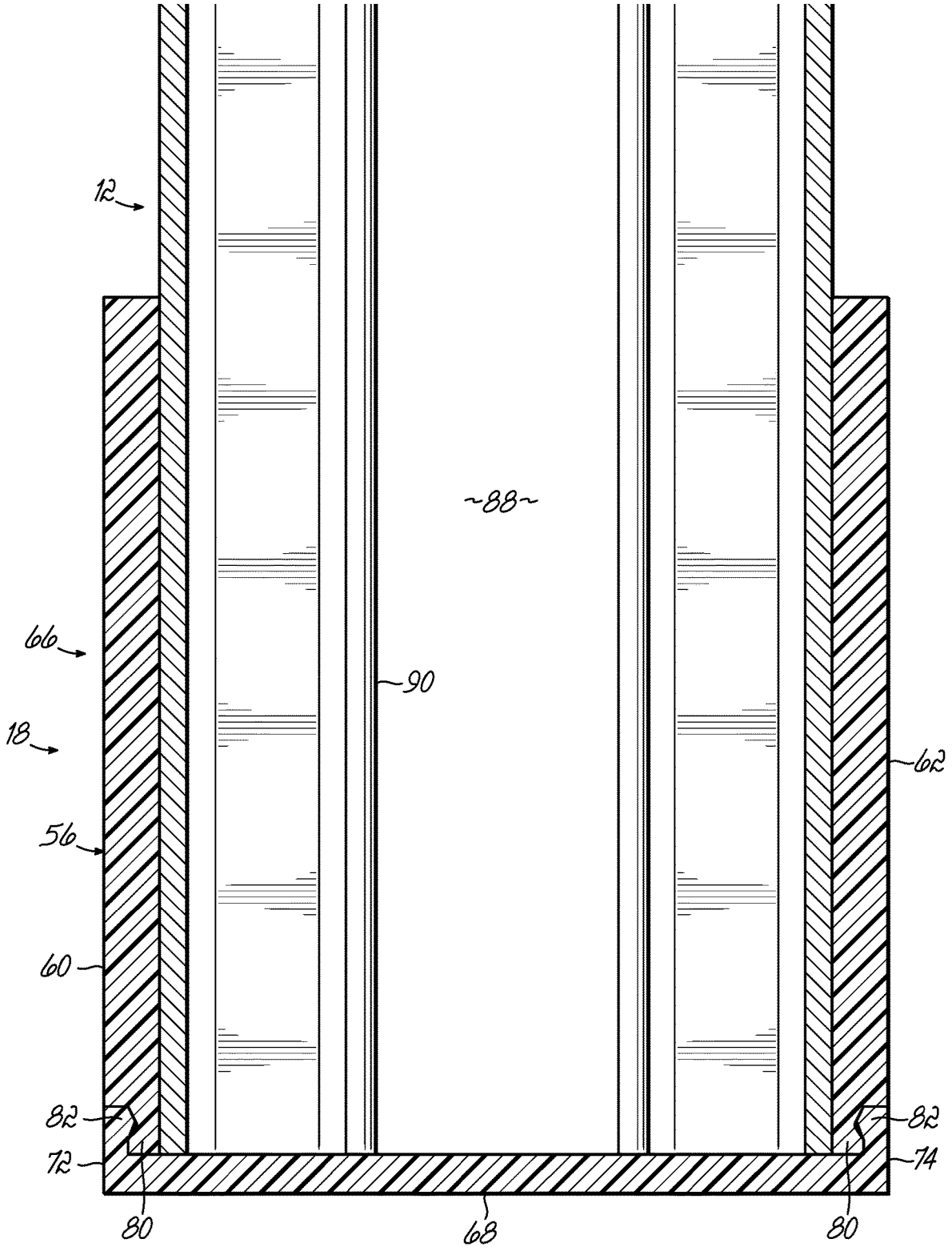
FIG. 13 is a bottom cross-sectional view of the curtain assembly shown in in FIG. 10 taken along line 13-13.

Referring now to FIG. 13, the figure shows a further cross-sectional view of the curtain assembly 10. Particularly, the figure shows a bottom cross-sectional view of an end of the curtain assembly 10—where the end cap 18 meets the curtain track 12. In the depicted embodiment, the end cap 18 is shown positioned such that the flange 68 of the end cap 18 abuts or nearly abuts an end face of the curtain track 12 when the flange 68 is in the closed position. It should be understood that the end cap 18 could be alternatively arranged. For example, the end cap 18 could be arranged such that there is gap between the flange 68 of the end cap 18 and the end face of the curtain track 12 when the flange 68 is in the closed position. In such an arrangement where there is a gap, the gap should be small enough such that a curtain hook 16 (or, more specifically, the hook head 42 of the curtain hook 16) cannot pass through the gap. In other words, even if there is a gap between the flange 68 and the end face of the curtain track 12, the gap should be small enough such that the flange 68 in the closed position still prevents curtain hooks 16 from entering or exiting the end of the curtain track 12.

Referring now to FIGS. 14 and 15, the figures show an alternative embodiment of the curtain hook 16. In contrast to the curtain hook 16 shown in FIGS. 3 and 4, for example, the hook head 42 of the curtain hook 16 shown in FIGS. 14 and 15 is substantially Y-shaped. Specifically, the top layer 44 and the bottom layer 46 of the hook head 42 are secured together to form a substantially Y-shaped hook head 42. The top layer 44 and the bottom layer 46 of the hook head 42 may be secured together by various fastening means, as described above with respect to FIGS. 3 and 4. Like the T-shaped hook head 42, the Y-shaped hook head 42 is configured to avoid catching on a mechanical fastener 86 extending into the cavity 88 of the curtain track 12, while also configured to be retained within the curtain track 12 to support the curtain 14 during use.

In a further alternative embodiment of the curtain hook 16, the curtain hook 16 may include a connector tab operatively connected to the hook body 50 and extending in a direction transverse to the hook body 50. The connector tab may feature one or more fasteners such that connector tabs of neighboring curtain hooks 16 may be connected to each other (or to the hook body 50 of the curtain hook 16) via the fasteners. The fastener may be hook and loop fastener, snap button(s), Block Tapey®, or a similar fastener. Such connecting of the curtain hooks 16 by the connector tabs may facilitate faster installation of the curtain hooks 16 into the curtain track 12. In addition to or in lieu of the connector tabs, the curtain hooks 16 (and, particularly the hook body 50) may include a tunnel for inserting a rod or baton through such that the curtain hooks 16 could be bunched up to facilitate faster installation of the curtain hooks 16 into the curtain track 12. Such connection and/or alignment features, while not shown in these Figures, will be understood to be positioned anywhere along the length of the hook body 50 depending on the preferences of the end user of the curtain assembly 10.

Figure 16:
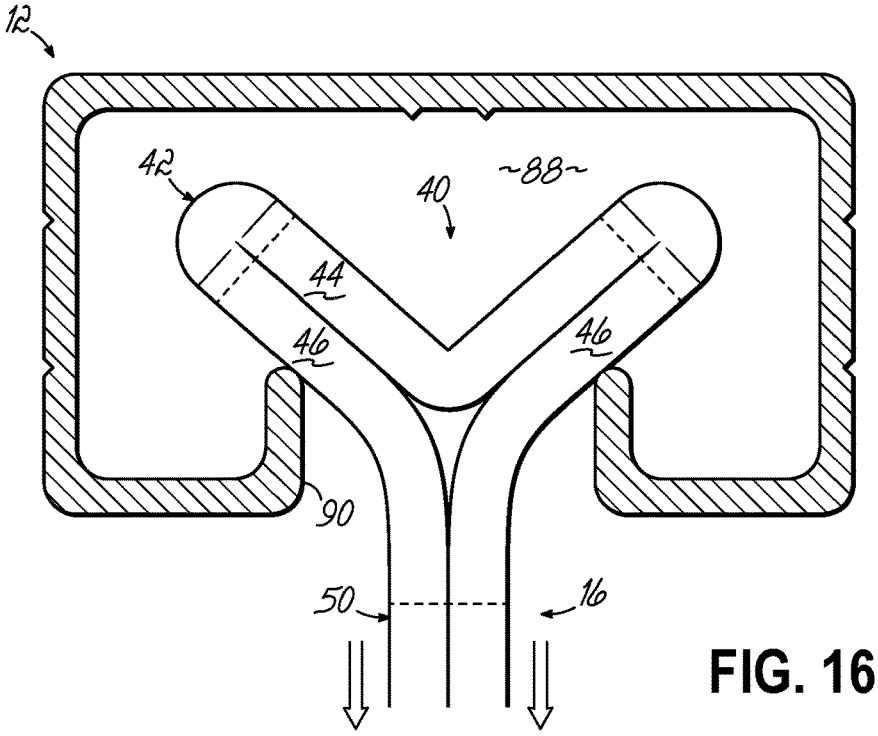
FIG. 16 is a cross-sectional view of a curtain assembly according to an alternative embodiment of the disclosure.
Figure 17:
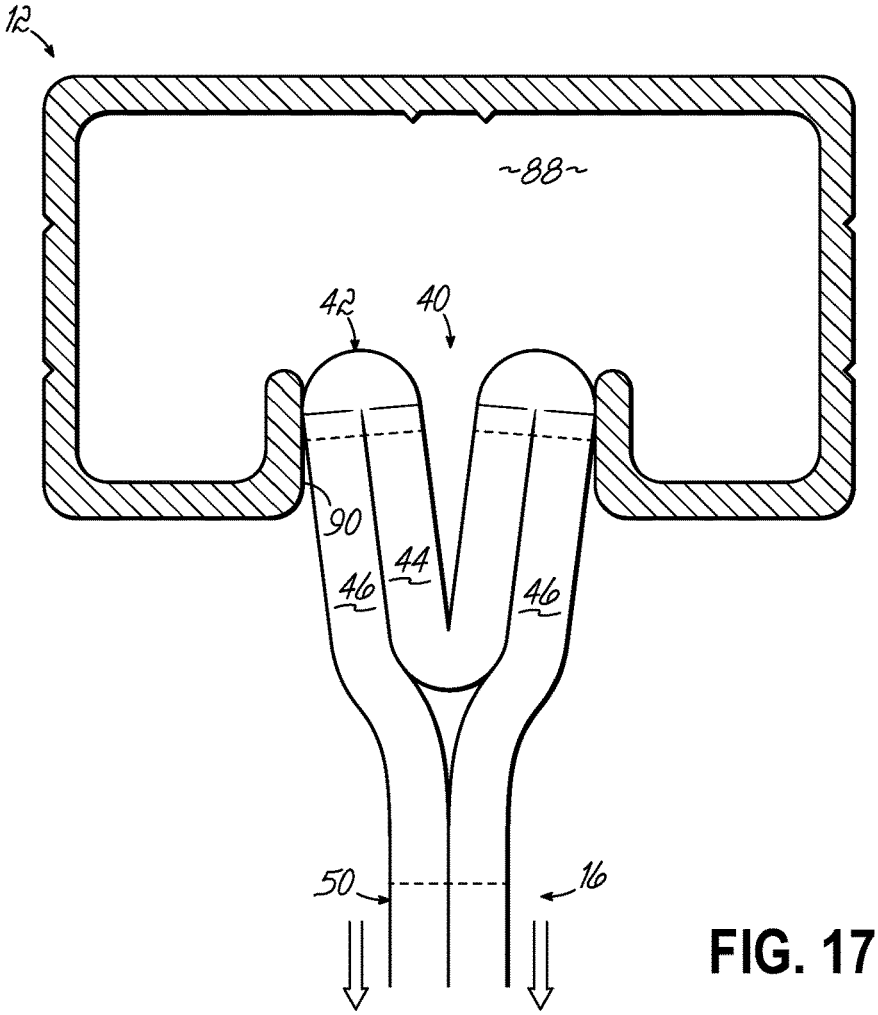
FIG. 17 is a cross-sectional view of the curtain assembly of FIG. 16, showing the curtain hook being pulled through a curtain track opening.
Figure 18:
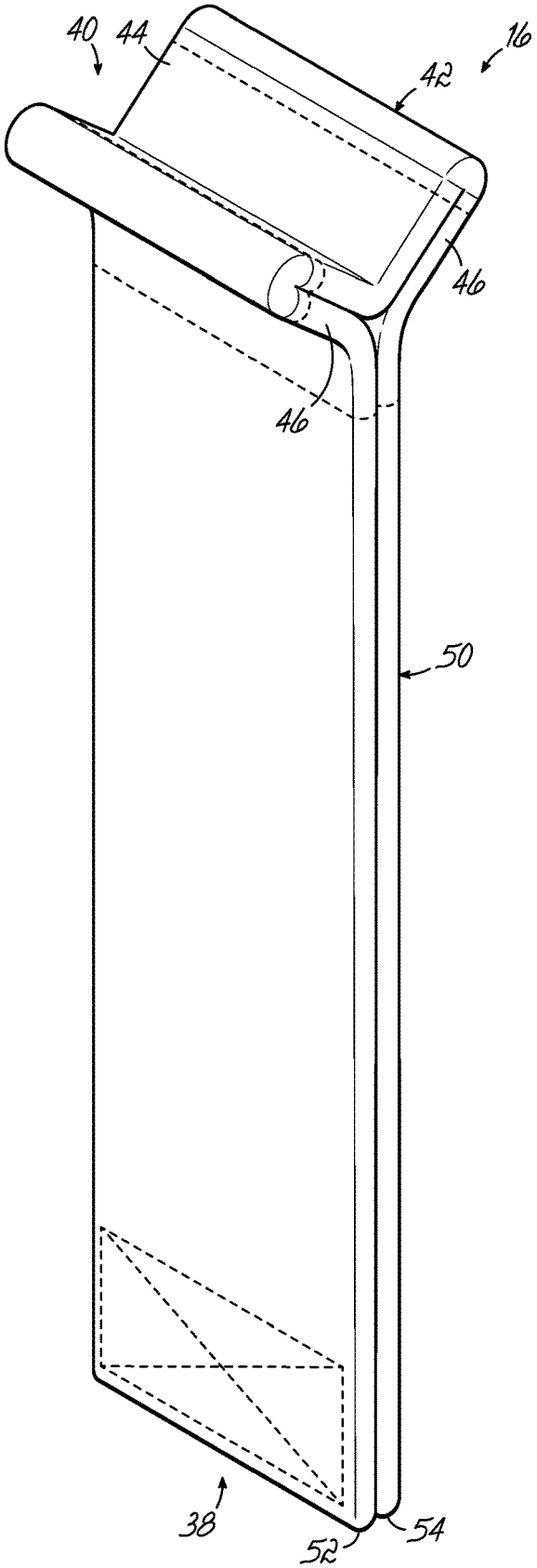
FIG. 18 is a perspective view of a curtain hook according to a further alternative embodiment of the disclosure.

Referring now to FIGS. 16 and 17, the figures illustrate that, in some instances, a curtain hook 16 of certain designs, such as the one just described with reference to FIGS. 14 and 15, may be pulled from the curtain track 12 instead of exiting through an end of the curtain track 12. Specifically, FIG. 17 shows the curtain hook 16 being pulled through a curtain track opening 90. In one embodiment, the curtain track opening 90 may be approximately 0.50 inches wide. In alternative embodiments, the curtain track opening 90 may be 0.48 inches wide or 0.43 inches wide, for example. While FIGS. 17 and 18 show a curtain hook 16 with a Y-shaped hook head 42 (e.g., of FIGS. 14 and 15), the same pulling could be performed with a T-shaped hook head 42 (e.g., of FIGS. 3 and 4)—either with or without the reinforcement layer 48.

Regardless of the particular form of the hook head 42, the pull force required to pull the curtain hook 16 through the curtain track opening 90 will be greater than the force of gravity on the curtain assembly 10. In other words, the curtain hooks 16 are configured such that it will require more than just the weight of the curtain 14 itself (and the curtain hooks 16) to pull the curtain hooks 16 from the curtain track 12 through the curtain track opening 90, such is shown in Table 1 below, for example. For all of Tables 1, 2, and 3 the pull out force was determined using an automated tensile tester. The curtain hook 16 was placed into a curtain track 12 with the curtain track opening 90 facing upwards. The curtain hook 16 was then pulled upwards at a standardized rate until the curtain hook 16 exited the curtain track 12 through the curtain opening 90.

TABLE 1

| Sample | Hook head shape | Reinforcement layer? | Center stitch? | Material | Thickness of material (mm) | Width of material (mm) | Width of hook head (mm) | Pull out force (lbs) |
|---|---|---|---|---|---|---|---|---|
| A | Y | Yes | Yes | Nylon | 2 | 17 | 29 | 74 |
| B | T | Yes | Yes | Nylon | 2 | 17 | 30 | 78 |
| C | T | Yes | Yes | Nylon | 2.2 | 17 | 29 | 45+ |
| D | T | Yes | No | Nylon | 2.2 | 17 | 29 | 45+ |
| E | Y | No | No | Nylon | 2.2 | 17 | 29 | 6 |
| F | T | No | No | Nylon | 2.2 | 17 | 30 | 5 |
| G | T | No | No | Polyester | 1.8 | 38 | 25 | 23 |
| H | Y | No | No | Polyester | 1.8 | 38 | 32 | 15 |

In one embodiment, pulling the curtain hook 16 through the curtain track opening 90 may require a pull force of at least 5 pounds. A relatively low pull force, such as 5 pounds, may be suitable for a behavioral health healthcare environment, for example. In an alternative embodiment, pulling the curtain hook 16 through the curtain track opening 90 may require a pull force of at least 10 pounds. In a further alternative embodiment, pulling the curtain hook 16 through the curtain track opening 90 may require a pull force of at least 15 pounds. In a further alternative embodiment, pulling the curtain hook 16 through the curtain track opening 90 may require a pull force of at least 20 pounds. In a further alternative embodiment, pulling the curtain hook 16 through the curtain track opening 90 may require a pull force of at least 45 pounds. In a further alternative embodiment, pulling the curtain hook 16 through the curtain track opening 90 may require a pull force of at least 50 pounds. In a further alternative embodiment, pulling the curtain hook 16 through the curtain track opening 90 may require a pull force of at least 70 pounds.

With continued reference to FIGS. 16 and 17, laundering and/or heating the curtain hook 16 (e.g., with the curtain 14) may change a material property of the curtain hook 16 such that the curtain hook 16 becomes stiffer (and/or more rigid) and then requires a greater (in comparison to an unlaundered and/or unheated curtain hook 16) pull force to pull the curtain hook 16 through the curtain track opening 90, such is shown in Tables 2 and 3 below. For Tables 2 and 3, the dryer used in the industrial laundering cycle was set to 160° F.

TABLE 2

| Sample F | |
|---|---|
| Number of industrial laundry cycles | Pull out force (lbs) |
| 0 | 6 |
| 1 | 20 |
| 2 | 22 |
| 3 | 30 |
| 4 | 40 |
| 5 | 45 |

TABLE 3

| Sample E | |
|---|---|
| Number of industrial laundry cycles | Pull out force (lbs) |
| 0 | 5 |
| 7 | 16 |

For one nylon, Y-shaped curtain hook 16 tested, prior to laundering and drying the curtain hook 16 required 6 pounds of pull force to pull the curtain hook 16 through the curtain track opening 90. After one industrial laundering cycle (with the dryer at 160° F.), the required pull force was 20 pounds. Further, successive launderings and/or heatings may further increase the pull force required to pull the curtain hook 16 through the curtain track opening 90. After two industrial laundering cycles, the required pull force was 22 pounds. After three industrial laundering cycles, the required pull force was 30 pounds. After four industrial laundering cycles, the required pull force was 40 pounds. After five industrial laundering cycles, the required pull force was 45 pounds.

With continued reference to FIGS. 16 and 17 as well as Tables 1-3, the particular shape of the hook head 42 may also impact the required pull force-both for unlaundered (and/or unheated) and laundered (and/or heated) curtain hooks 16. For example, for one nylon, T-shaped curtain hook 16 tested, prior to laundering, the curtain hook 16 required 5 pounds of pull force to pull the curtain hook 16 through the curtain track opening 90. After seven industrial laundering cycles (with the dryer at 160° F.), the required pull force was 16 pounds. Further, the absence or addition of a reinforcement layer 48 may impact the required pull force-both for unlaundered (and/or unheated) and laundered (and/or heated) curtain hooks 16. For example, for one nylon, T-shaped curtain hook 16 tested, without the reinforcement layer 48, the pull force required was 5 pounds. With the reinforcement layer 48, the pull force required was more than 45 pounds. Further, the absence or addition of a center stitch may impact the required pull force-both for unlaundered (and/or unheated) and laundered (and/or heated) curtain hooks 16. For example, for one nylon, T-shaped curtain hook 16 tested, without the center stitch, the pull force required was 45 pounds. With the center stitch, the pull force required was more than 75 pounds.

Referring now to FIG. 18, the figure shows a further alternative embodiment of the curtain hook 16. As shown in the depicted embodiment, the various dimensions of the curtain hook 16 may vary without departing from the inventive concepts of this disclosure. For example, the hook body 50 may be longer or shorter than what is expressly shown. A longer hook body 50 may be desirable if the ceiling 20 of the room in which the curtain assembly 10 is to be used is particularly high. Alternatively, a longer hook body 50 may be desirable to satisfy NFPA701 fire code, for example, that can require an open area of 70% for the top 18 inches of a curtain. Similarly, the curtain hook 16 may be wider or narrower than what is expressly shown. A wider curtain hook 16 may be desirable if the curtain 14 to be hung from the curtain hooks 16 is particularly heavy. The wider curtain hook 16 may better support the weight of a heavier curtain 14 than a narrower curtain hook 16. Further, it should be understood that other dimensions, the shape, etc. of the curtain hook 16 may vary without departing from the inventive aspects of this disclosure.

While the present invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A curtain assembly comprising:

a curtain track including a cavity extending along a length of the curtain track, the curtain track configured to be secured to a ceiling or a wall;

a curtain suspended from the curtain track, the curtain defined by a first lateral edge, a second lateral edge, a top edge, and a bottom edge;

a plurality of hooks suspending the curtain from the curtain track, at least one hook of the plurality of hooks having a first end and a second end opposite the first end, the first end operatively connected to the curtain adjacent the top edge of the curtain, the second end configured to be housed within the cavity of the curtain track to slidably secure the curtain to the curtain track; and a monolithic end cap located adjacent to and surrounding an exterior portion of an end of the curtain track, a portion of the end cap configured to selectively transition between an open position and a closed position, wherein in the closed position, the portion of the end cap is configured to restrict the at least one hook of the plurality of hooks from entering or exiting the cavity via the end of the curtain track, wherein the end cap comprises:

an end cap body including an end wall, a first side wall, and a second side wall, the first side wall and the second side wall connected to and extending from the end wall, the end cap body defining an inner periphery configured to face towards the curtain track and an outer periphery configured to face away from the curtain track, the inner periphery of the end cap body arranged in a confronting relationship with the exterior of the curtain track; and a flange pivotably connected to the end wall of the end cap body by a living hinge, the flange configured to selectively transition between the open position and the closed position, in the closed position the flange configured to restrict the at least one hook of the plurality of hooks from entering or exiting the cavity via the end of the curtain track, wherein the end wall is secured to be fixed in position on the curtain track when the end cap is releasably secured to the curtain track.

2. The curtain assembly of claim 1, wherein the first wall of the end cap body includes a lip portion at an end of the first wall, wherein the second wall of the end cap body includes a lip portion at an end of the second wall, wherein the flange includes a first catch feature and a second catch feature, the first catch feature and the second catch feature located on opposing lateral edges of the flange adjacent the living hinge, and wherein in the closed position the lip portion of the first wall interfaces with the first catch feature of the flange and the lip portion of the second wall interface with the second catch feature of the flange to selectively restrict the at least one hook of the plurality of hooks from entering or exiting the cavity via the end of the curtain track.

3. The curtain assembly of claim 1, wherein in the closed position the flange is substantially parallel to an end face of the curtain track.

4. The curtain assembly of claim 1, wherein the first side wall of the end cap overlaps the exterior of the curtain track for a majority of a length and a width of the first side wall, and wherein the second side wall of the end cap overlaps the exterior of the curtain track for a majority of a length and a width of the second side wall.

5. The curtain assembly of claim 1, wherein the end wall of the end cap body extends an end wall width between the first wall and the second wall, wherein the flange extends a flange width between a first lateral edge of the flange and a second lateral edge of the flange, and wherein a width of the living hinge is substantially coextensive with the end wall width and the flange width.

6. The curtain assembly of claim 1, wherein the end cap is releasably secured to the curtain track by a transition and/or interference fit between the end cap and the curtain track.

7. The curtain assembly of claim 6, wherein the end wall of the end cap further comprises an aperture, and wherein a mechanical fastener passes through both the curtain track and the aperture of the end wall of the end cap to releasably secure the end cap to the curtain track.

8. The curtain assembly of claim 1, the at least one hook of the plurality of hooks comprising:

a hook head at the second end of the at least one hook, the hook head including a top layer and a bottom layer, the top layer and the bottom layer secured together to form the hook head; and a hook body extending away from the hook head, the hook body terminating in the first end of the at least one hook.

9. The curtain assembly of claim 1, wherein the curtain includes a first face and a second face, the second face located diametrically opposite the first face, wherein the curtain includes curtain fasteners located adjacent the first lateral edge and located adjacent the second lateral edge of the curtain, wherein the curtain fasteners located adjacent the first lateral edge are on the second face of the curtain, and wherein the curtain fasteners located adjacent the second lateral edge are on the first face of the curtain, the curtain fasteners configured to selectively secure the curtain to a neighboring curtain.

10. The curtain assembly of claim 8, wherein the hook head includes a reinforcement layer located between the top layer and the bottom layer of the hook head, the reinforcement layer secured to the top layer of the hook head, the reinforcement layer configured to add additional rigidity to the hook head.

11. The curtain assembly of claim 8, wherein the top layer and the bottom layer of the hook head are secured together by fastening selected from the group consisting of: stitching, thermal welding, ultrasonic welding, and adhesive.

12. The curtain assembly of claim 8, wherein the at least one hook of the plurality of hooks is fixed to the curtain so as not to be readily removeable from the curtain, and wherein the at least one hook of the plurality of hooks is configured to be laundered with the curtain.

13. The curtain assembly of claim 8, wherein the curtain includes a first face and a second face, the second face located diametrically opposite the first face, and wherein the at least one hook of the plurality of hooks is operatively connected to at least one of the first face of the curtain or the second face of the curtain.

14. The curtain assembly of claim 13, wherein the at least one hook of the plurality of hooks is operatively connected to both of the first face of the curtain and the second face of the curtain.

15. The curtain assembly of claim 8, wherein the at least one hook of the plurality of hooks is constructed of a textile material.

16. The curtain assembly of claim 15, wherein the at least one hook of the plurality of hooks is constructed so as to form a single contiguous piece of textile material.

17. The curtain assembly of claim 14, wherein the textile material is selected from the group consisting of: nylon, polyester, cotton, and polypropylene.

18. The curtain assembly of claim 14, wherein the at least one hook of the plurality of hooks is configured to increase in stiffness when laundered and/or heated such that a pull force required to pull the at least one hook through a curtain track opening increases after one or more cycles of being laundered and/or heated.

19. A curtain assembly comprising:

a curtain track including a cavity extending along a length of the curtain track, the curtain track configured to be secured to a ceiling or a wall;

a curtain suspended from the curtain track, the curtain defined by a first lateral edge, a second lateral edge, a top edge, and a bottom edge;

a plurality of hooks suspending the curtain from the curtain track, at least one hook of the plurality of hooks having a first end and a second end opposite the first end, the first end operatively connected to the curtain adjacent the top edge of the curtain, the second end configured to be housed within the cavity of the curtain track to slidably secure the curtain to the curtain track; and a monolithic end cap located adjacent to and surrounding an exterior portion of an end of the curtain track, a portion of the end cap configured to selectively transition between an open position and a closed position, wherein in the closed position, the portion of the end cap is configured to restrict the at least one hook of the plurality of hooks from entering or exiting the cavity via the end of the curtain track, wherein the at least one hook of the plurality of hooks comprises:

a hook head at the second end of the at least one hook, the hook head including a top layer and a bottom layer, the top layer and the bottom layer secured together to form the hook head; and a hook body extending away from the hook head, the hook body terminating in the first end of the at least one hook, wherein the top layer and the bottom layer of the hook head are secured together to form a substantially Y-shaped hook head, the substantially Y-shaped hook head configured to avoid catching on a fastener extending into the cavity of the curtain track.

20. The curtain assembly of claim 19, wherein the substantially Y-shaped hook head includes a middle portion with a depression at the top layer which extends downwardly towards the first end of the at least one hook to provide a gap clearance above the top layer at the middle portion, thereby allowing the substantially Y-shaped hook head to move past any fastener extending into the cavity of the curtain track without catching on the fastener.

21. A curtain assembly comprising:

a curtain track including a cavity extending along a length of the curtain track, the curtain track configured to be secured to a ceiling or a wall;

a curtain suspended from the curtain track, the curtain defined by a first lateral edge, a second lateral edge, a top edge, and a bottom edge;

a plurality of hooks suspending the curtain from the curtain track, at least one hook of the plurality of hooks having a first end and a second end opposite the first end, the first end operatively connected to the curtain adjacent the top edge of the curtain, the second end configured to be housed within the cavity of the curtain track to slidably secure the curtain to the curtain track; and a monolithic end cap located adjacent to and surrounding an exterior portion of an end of the curtain track, a portion of the end cap configured to selectively transition between an open position and a closed position, wherein in the closed position, the portion of the end cap is configured to restrict the at least one hook of the plurality of hooks from entering or exiting the cavity via the end of the curtain track, wherein the at least one hook of the plurality of hooks comprises:

a hook head at the second end of the at least one hook, the hook head including a top layer and a bottom layer, the top layer and the bottom layer secured together to form the hook head; and a hook body extending away from the hook head, the hook body terminating in the first end of the at least one hook, wherein the top layer and the bottom layer of the hook head are secured together to form a substantially T-shaped hook head, the substantially T-shaped hook head configured to avoid catching on a fastener extending into the cavity of the curtain track, and wherein the substantially T-shaped hook head includes a middle portion with a depression at the top layer which extends downwardly towards the first end of the at least one hook to provide a gap clearance above the top layer at the middle portion, thereby allowing the substantially T-shaped hook head to move past a fastener extending into the cavity of the curtain track without catching on the fastener.

* * * * *